US009142346B2

(12) United States Patent
Itou et al.

(10) Patent No.: US 9,142,346 B2
(45) Date of Patent: Sep. 22, 2015

(54) TRANSFORMER

(75) Inventors: Hideki Itou, Toyokawa (JP); Yuji Hayashi, Kasugai (JP); Masamichi Ishikawa, Hekinan (JP)

(73) Assignee: DENSO CORPORATION, Kariya (JP)

( * ) Notice: Subject to any disclaimer, the term of this patent is extended or adjusted under 35 U.S.C. 154(b) by 363 days.

(21) Appl. No.: 13/432,087

(22) Filed: Mar. 28, 2012

(65) Prior Publication Data

US 2012/0249279 A1 Oct. 4, 2012

(30) Foreign Application Priority Data

Mar. 29, 2011 (JP) ..... 2011-072154
Dec. 13, 2011 (JP) ..... 2011-272495

(51) Int. Cl.

| | |
|---|---|
| ***H01F 27/28*** | (2006.01) |
| ***H01F 5/00*** | (2006.01) |
| ***H01F 17/04*** | (2006.01) |
| ***H01F 27/32*** | (2006.01) |
| *H01F 27/30* | (2006.01) |

(52) U.S. Cl.

CPC ..... *H01F 27/324* (2013.01); *H01F 27/325* (2013.01); *H01F 27/306* (2013.01)

(58) Field of Classification Search

CPC ..... H01F 27/38; H01F 27/2823
USPC ..... 336/170, 182, 220, 221, 200, 232
See application file for complete search history.

(56) References Cited

U.S. PATENT DOCUMENTS

| | | | | |
|---|---|---|---|---|
| 6,023,214 | A * | 2/2000 | Ohta et al. | 336/84 R |
| 7,199,569 | B1 * | 4/2007 | Nakahori | 323/355 |
| 7,830,237 | B1 * | 11/2010 | Chen | 336/220 |
| 2003/0179067 | A1 * | 9/2003 | Gamou et al. | 336/223 |
| 2004/0070480 | A1 * | 4/2004 | Nakashima et al. | 336/200 |
| 2006/0028313 | A1 * | 2/2006 | Strzalkowski et al. | 336/223 |
| 2007/0273465 | A1 * | 11/2007 | Feng et al. | 336/212 |
| 2008/0079524 | A1 * | 4/2008 | Suzuki | 336/61 |
| 2008/0211613 | A1 * | 9/2008 | Lin et al. | 336/83 |
| 2009/0045900 | A1 * | 2/2009 | Tsai et al. | 336/180 |

FOREIGN PATENT DOCUMENTS

| | | | |
|---|---|---|---|
| JP | 08-316079 | | 11/1996 |
| JP | 08316079 | A * | 11/1996 |
| JP | 11-354342 | | 12/1999 |
| JP | 2002-237416 | | 8/2002 |
| JP | 2002-237419 | | 8/2002 |
| JP | 2002237419 | A * | 8/2002 |
| JP | 2004-303746 | | 10/2004 |
| JP | 2004303746 | A * | 10/2004 |
| JP | 2004303857 | A * | 10/2004 |
| JP | 4059396 | | 12/2007 |
| JP | 2008-004823 | | 1/2008 |

OTHER PUBLICATIONS

Office Action (4 pages) dated Aug. 6, 2013, issued in corresponding Japanese Application No. 2011-272495 and English translation (3 pages).

* cited by examiner

*Primary Examiner* — Tsz Chan
(74) *Attorney, Agent, or Firm* — Nixon & Vanderhye P.C.

(57) ABSTRACT

A transformer includes a pair of first coils and at least one second coil. The first and second coils are stacked so that the at least one second coil is interposed between the first coils in a common winding axial direction of the first and second coils. Each of the first coils is covered by insulating films and integrated with the insulating films into an integrated body, so that the first coils are electrically insulated from the at least one second coil.

8 Claims, 20 Drawing Sheets

TRANSFORMER

CROSS-REFERENCE TO RELATED APPLICATIONS

This application is based on and claims priority from Japanese Patent Applications No. 2011-72154 filed on Mar. 29, 2011 and No. 2011-272495 filed on Dec. 13, 2011, the contents of which are hereby incorporated by reference in their entireties into this application.

BACKGROUND

1. Technical Field

The present invention relates to transformers which include a plurality of coils that are electrically insulated from each other and stacked in a common winding axial direction thereof.

2. Description of the Related Art

There are known transformers which are used in, for example, DC-DC converters. Those transformers include, as shown in FIG. 30, a high voltage-side coil 91 and a pair of low voltage-side coils 92 that are electrically insulated from each other and stacked in a common winding axial direction thereof (i.e., the direction of the winding axes of the coils 91 and 92 which coincide with each other). More specifically, the coils 91 and 92 are stacked so that the high voltage-side coil 91 is interposed between the low voltage-side coils 92 in the winding axial direction. Further, the coils 91 and 92 are together sandwiched by a pair of core pieces 93 in the winding axial direction. With the core pieces 93, magnetic paths can be formed on both the radially inside and radially outside of the coils 91 and 92.

Moreover, electrical insulation between the high voltage-side coil 91, the low voltage-side coils 92 and the core pieces 93 is secured by interposing therebetween bobbins 94 that are made of an electrically-insulative material. However, with the bobbins 94, both the size and parts count of the transformer 9 are increased and the assembly process of the transformer 9 is complicated.

To solve the above problem, Japanese Patent Application Publication No. 2004-303857 discloses a technique, according to which the high voltage-side coil 91 is comprised of a substrate that has coil patterns formed on both the major surfaces thereof and insulating layers 911 that cover the coil patterns. Consequently, the high voltage-side coil 91 is electrically insulated from the low voltage-side coils 92 without interposing the bobbins 94 between the high voltage-side coil 91 and the low voltage-side coils 92.

However, with the above technique, it is still necessary to interpose the bobbins 94 between the low voltage-side coils 92 and the core pieces 93 for securing the electrical insulation therebetween. Consequently, it is difficult to minimize both the size and parts count of the transformer 9 and simplify the assembly process of the transformer 9.

SUMMARY

According to an exemplary embodiment, a transformer is provided which includes a pair of first coils and at least one second coil. The first and second coils are stacked so that the at least one second coil is interposed between the first coils in a common winding axial direction of the first and second coils. Each of the first coils is covered by insulating films and integrated with the insulating films into an integrated body, so that the first coils are electrically insulated from the at least one second coil.

With the above configuration, electrical insulation between the first coils and the at least one second coil is secured by means of the thin insulating films that cover the first coils. Consequently, it becomes possible to minimize the thickness of the transformer in the winding axial direction while securing the electrical insulation between the first coils and the at least one second coil. Moreover, since each of the first coils is integrated with the insulating films into one integrated body, the parts count of the transformer is prevented from increasing and the assembly process of the transformer is prevented from becoming complicated.

Accordingly, with the above configuration, it is possible to minimize both the size and parts count of the transformer and simplify the assembly process of the transformer while securing the electrical insulation between the first coils and the at least one second coil.

In a further implementation, the transformer further includes a core that is comprised of a pair of core pieces. The integrated bodies, each of which is comprised of one of the first coils and the insulating films covering the one of the first coils, and the at least one second coil are together interposed between and thereby covered by the pair of core pieces in the winding axial direction.

In this case, since the at least one second coil is interposed between the first coils in the winding axial direction, the at least one second coil is prevented from making contact with the core pieces that are arranged outside of the first coils in the winding axial direction. Consequently, electrical insulation between the at least one second coil and the core pieces is secured without employing any additional insulating means (e.g., bobbins). Moreover, electrical insulation between the first coils and the core pieces is also secured by means of the thin insulating films that cover the first coils.

In still further implementations, each of the first coils is comprised of a plurality of coil segments that are stacked in the winding axial direction. Between each adjacent pair of the coil segments, there is interposed an insulating film so as to electrically insulate the coil segments from each other.

The integrated bodies, each of which is comprised of one of the first coils and the insulating films covering the one of the first coils, are substantially annular-shaped. The at least one second coil is also substantially annular-shaped. The radially inner periphery of the at least one second coil is positioned radially outside of the radially inner peripheries of the insulating films of the integrated bodies, and the radially outer periphery of the at least one second coil is positioned radially inside of the radially outer peripheries of the insulating films.

The at least one second coil is bonded by an adhesive to a corresponding one of the integrated bodies.

The integrated bodies are formed of a coil sheet. In the coil sheet, the integrated bodies are connected with each other via a connecting portion. The coil sheet is folded at the connecting portion so that the integrated bodies are superposed in the winding axial direction. The connecting portion of the coil sheet includes therein a connecting electric conductor that connects the first coils included in the respective integrated bodies.

Further, in the coil sheet, there are provided two coil terminals that protrude respectively from the integrated bodies in a direction perpendicular to both the winding axial direction and an extending direction of the connecting portion of the coil sheet.

Each of the core pieces of the core has a center portion that extends in the winding axial direction. The center portions of the core pieces are inserted in a space formed radially inside of the integrated bodies and the at least one second coil. The insulating films of the integrated bodies have extensions that extend in the winding axial direction along the outer surfaces of the center portions of the core pieces, so as to be radially interposed between the outer surfaces of the center portions of the core pieces and the radially inner surface of the at least one second coil.

Each of the first coils is comprised of a large-linewidth coil segment and a small-linewidth coil segment that are stacked in the winding axial direction. The at least one second coil is directly thermally connected to a heat sink. The first coils and the at least one second coil are stacked so that the large-linewidth coil segments of the first coils face the at least one second coil.

BRIEF DESCRIPTION OF THE DRAWINGS

The present invention will be understood more fully from the detailed description given hereinafter and from the accompanying drawings of exemplary embodiments, which, however, should not be taken to limit the invention to the specific embodiments but are for the purpose of explanation and understanding only.

In the accompanying drawings.

DESCRIPTION OF EMBODIMENTS

Figure 1:
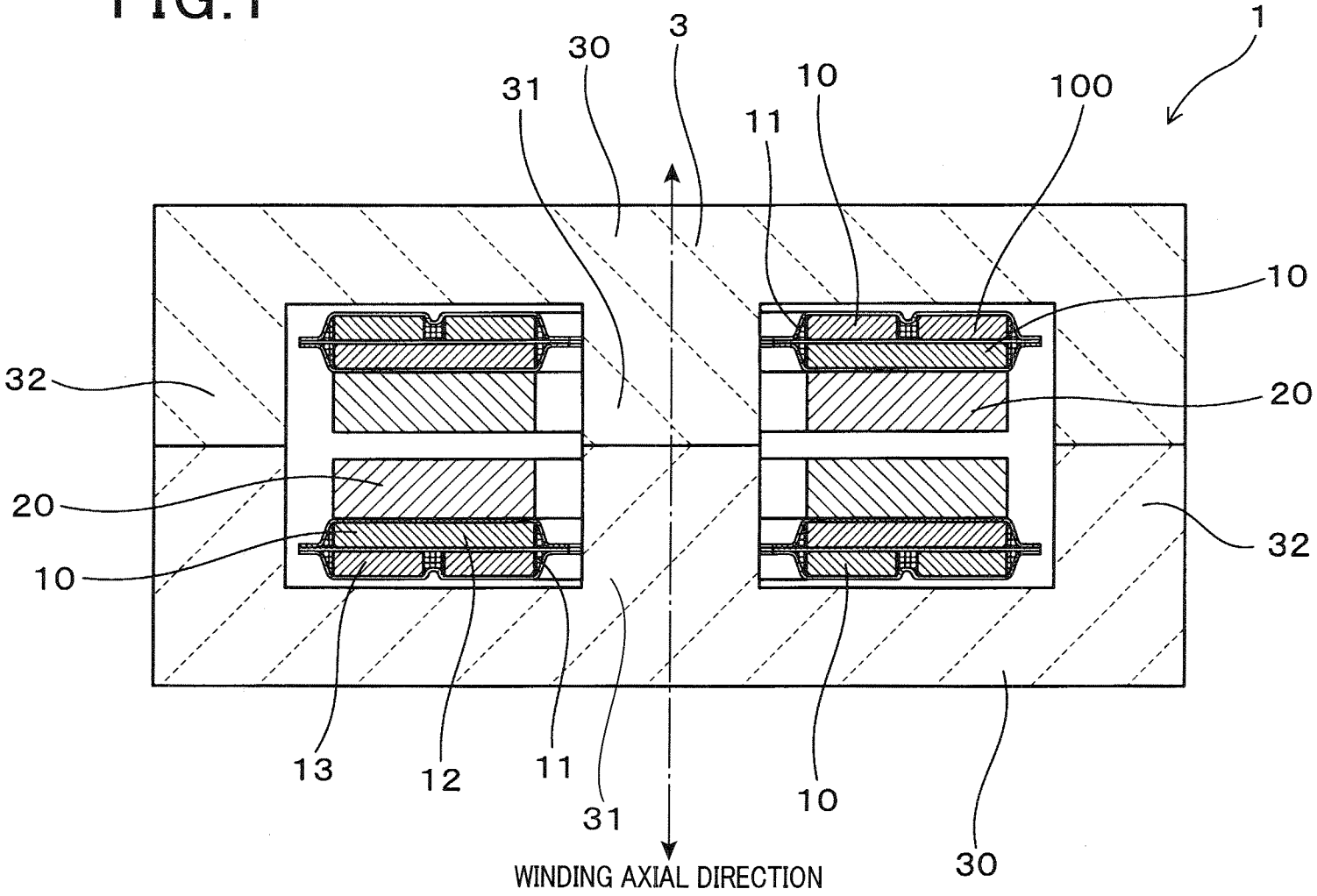
FIG. 1 is a cross-sectional view illustrating the overall configuration of a transformer according to a first embodiment.

Exemplary embodiments will be described hereinafter with reference to FIGS. 1-29. It should be noted that for the sake of clarity and understanding, identical components having identical functions in different embodiments have been marked, where possible, with the same reference numerals in each of the figures and that for the sake of avoiding redundancy, descriptions of the identical components will not be repeated.

[First Embodiment]

Figure 4:
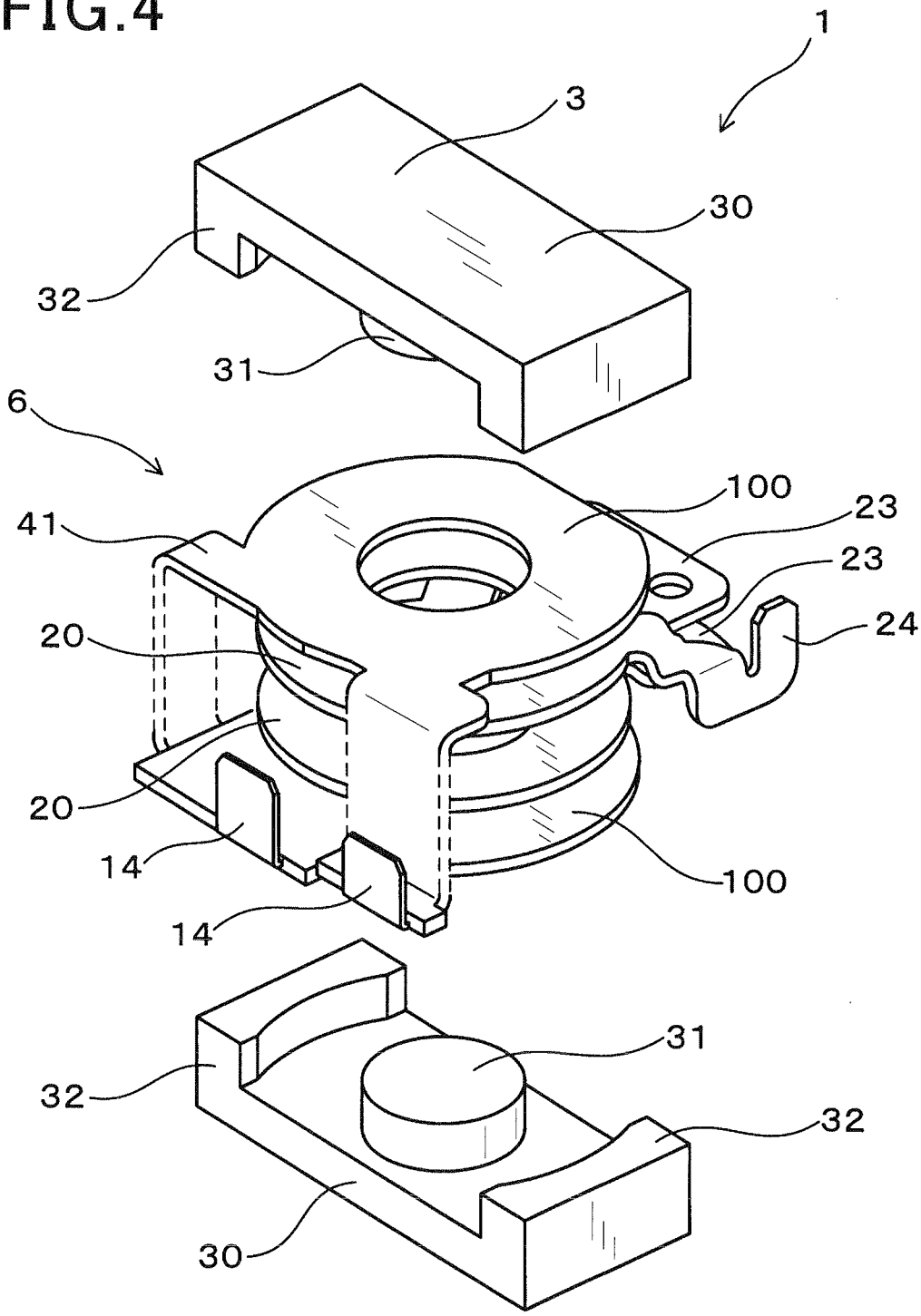
FIG. 4 is an exploded perspective view of the transformer.

Referring to FIGS. 1 and 4, a transformer 1 according to the first embodiment includes a pair of first coils 10 and a pair of second coils 20. The first and second coils 10 and 20 are electrically insulated from each other and stacked (or superposed) in a common winding axial direction thereof (i.e., the direction of the winding axes of the coils 10 and 20 which coincide with each other).

Figure 2:
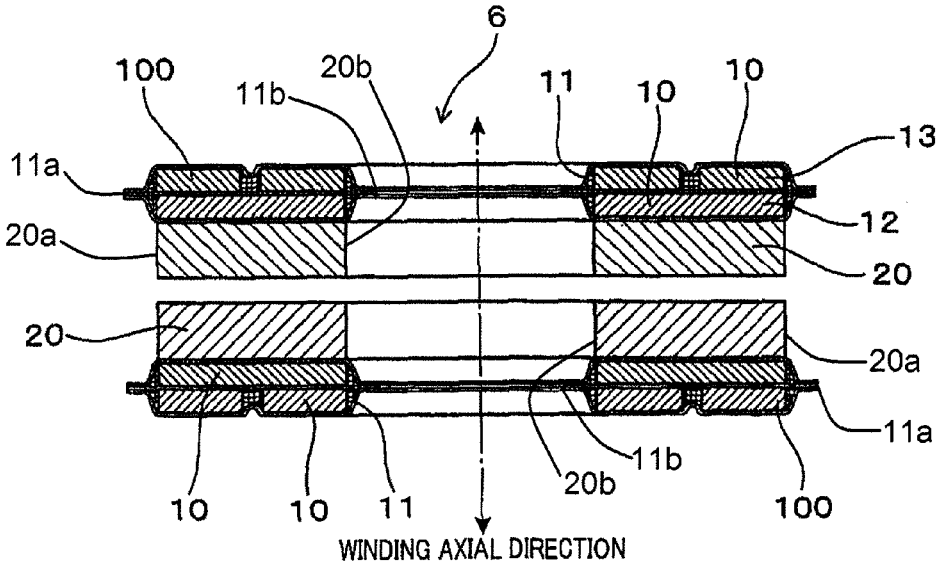
FIG. 2 is a cross-sectional view of a stacked body of the transformer.

Moreover, as shown in FIGS. 1 and 2, each of the first coils 10 is covered by insulating films 11 and integrated with the insulating films 11 into an integrated body 100. Accordingly, there are two integrated bodies 100 included in the transformer 1.

The first and second coils 10 and 20 are stacked so that the pair of second coils 20 is interposed between the first coils 10 in the winding axial direction.

In the present embodiment, the transformer 1 is configured as a step-down transformer. The transformer 1 may be used in, for example, an electric vehicle or a hybrid vehicle to step down (or reduce) voltage for charging a low-voltage power source with electric power supplied by a high-voltage power source. In addition, the first coils 10 are configured as primary and high voltage-side coils, and the second coils 20 are configured as secondary and low voltage-side coils.

Each of the first and second coils 10 and 20 has a substantially annular shape. In addition, each of the integrated bodies 100 also has a substantially annular shape.

As shown in FIG. 2, the integrated bodies 100, each of which is comprised of one of the first coils 10 and the insulating films 11 covering the first coil 10, and the second coils 20 are stacked together to form a stacked body 6.

Further, as shown in FIGS. 1 and 4, the transformer 1 also includes a core 3 that is made of a magnetic material, such as ferrite, and arranged to cover the stacked body 6.

Specifically, in the present embodiment, the core 3 is comprised of a pair of core pieces 30 that are respectively arranged on opposite sides of the stacked body 6 in the winding axial direction so as to together sandwich the stacked body 6 in the winding axial direction.

Each of the core pieces 30 includes a center magnetic leg 31 and a pair of side magnetic legs 32. The center magnetic leg 31 is inserted into the radially inner space of the stacked body 6, while the side magnetic legs 32 are located radially outside of the stacked body 6 so as to be respectively positioned on opposite sides of the stacked body 6.

Each of the first coils 10 is formed by stacking two coil segments, each of which is obtained by punching a metal plate into a coil shape, in the thickness direction thereof and joining a corresponding pair of ends of the two coil segments.

Figure 7:
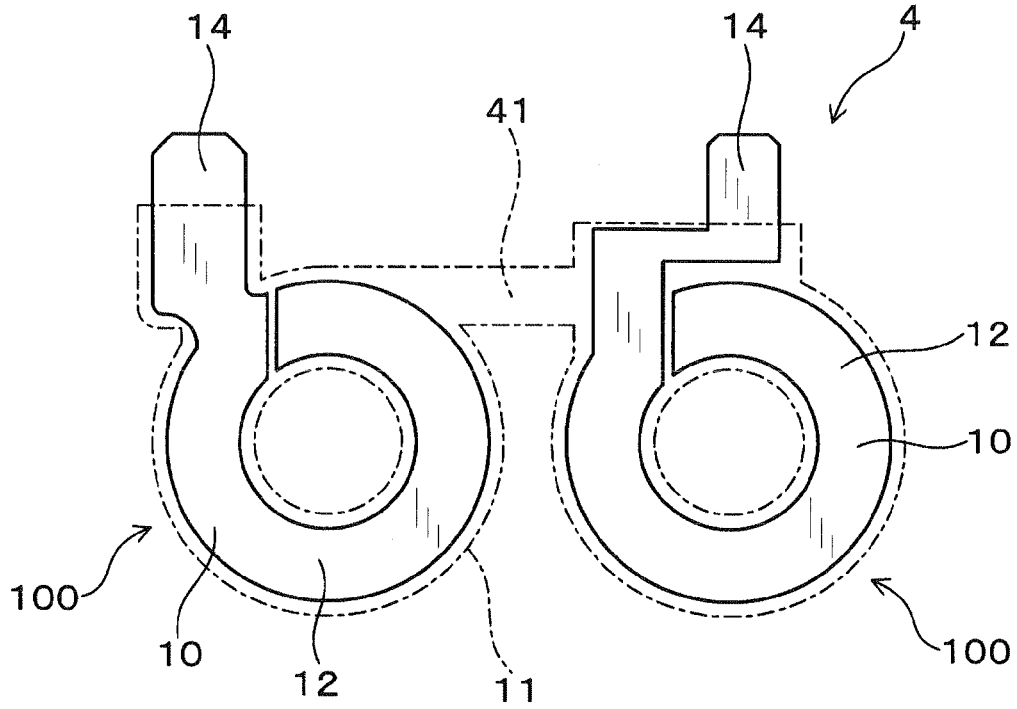
FIG. 7 is a plan view illustrating a pair of large-linewidth electric conductor plates included in the coil sheet before being folded.
Figure 8:
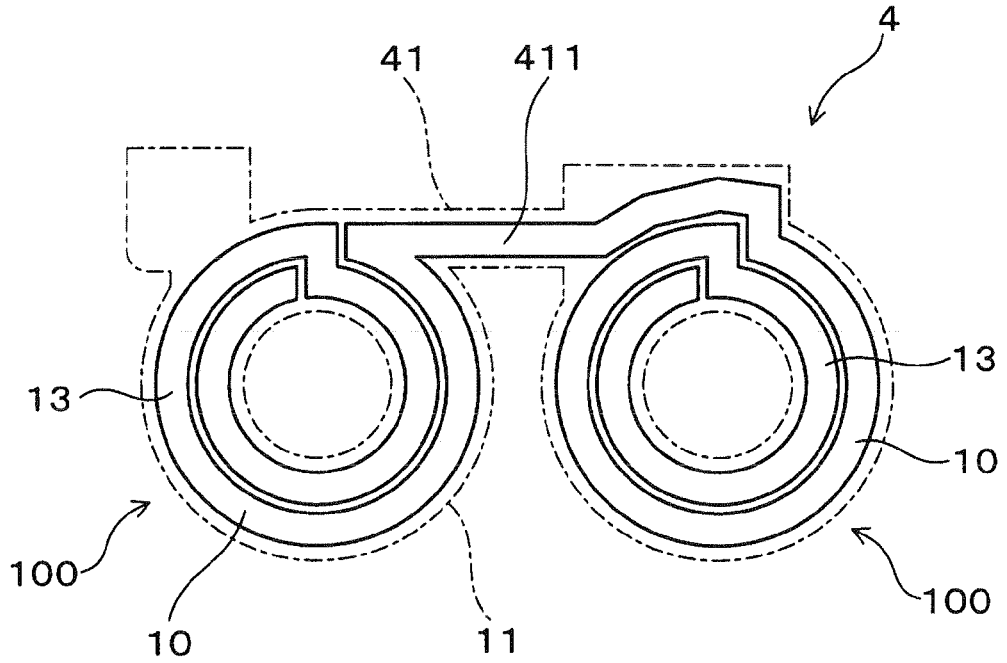
FIG. 8 is a plan view illustrating a pair of small-linewidth electric conductor plates included in the coil sheet before being folded.

Specifically, as shown in FIGS. 2, 7 and 8, each of the first coils 10 is formed by stacking a large-linewidth electric conductor plate 12 and a small-linewidth electric conductor plate 13 in their thickness direction with an insulating film 11 interposed therebetween. The linewidth of the small-linewidth electric conductor plate 13 is less than or equal to half the linewidth of the large-linewidth electric conductor plate 12. Moreover, the large-linewidth electric conductor plate 12 is substantially annular-shaped so that the number of turns of the plate 12 is equal to 1. On the other hand, the small-linewidth electric conductor plate 13 is substantially spiral-shaped so that the number of turns of the plate 13 is equal to 2. Further, one end of the large-linewidth electric conductor plate 12 is electrically connected, for example by welding, to one end of the small-linewidth electric conductor plate 13. Consequently, the total number of turns of the first coil 13 is equal to 3.

Figure 3:
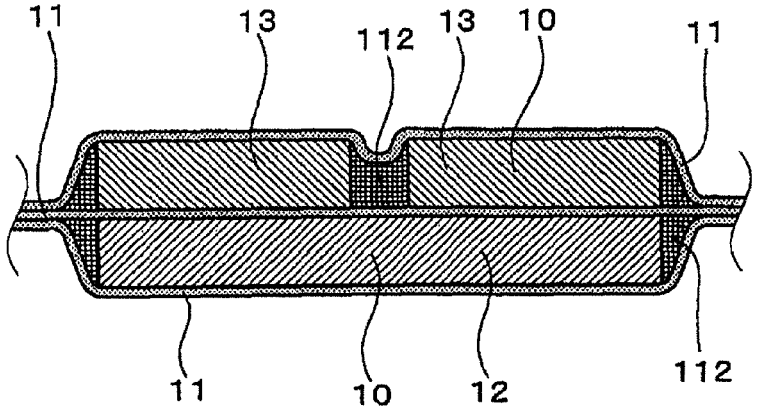
FIG. 3 is a cross-sectional view of part of an integrated body of a first coil and insulating films, the integrated body being included in the stacked body.

Referring to FIGS. 2 and 3, each of the integrated bodies 100 is formed by stacking the large-linewidth and small-linewidth electric conductor plates 12 and 13 of the first coil 10 and three insulating films 11 so that each of the plates 12 and 13 is interposed between an adjacent pair of the insulating films 11 in the winding axial direction. Further, the three insulating films 11 are crimped on both the radially inside and radially outside of the integrated bodies 100. In addition, the insulating films 11 are also crimped between the radially inner and radially outer turns of the small-linewidth electric conductor plate 13. Moreover, an adhesive 112 is filled into all the void spaces of the integrated body 100 which are formed between the insulating films 11 and the large-linewidth and small-linewidth electric conductor plates 12 and 13. Consequently, all of the insulating films 11 and the large-linewidth and small-linewidth electric conductor plates 12 and 13 are bonded together by the adhesive 112.

In addition, as described previously, the corresponding ends of the large-linewidth and small-linewidth electric conductor plates 12 and 13 are joined together by, for example, welding, forming a joining portion therebetween. Though not shown in the figures, the joining portion extends to penetrate that of the insulating films 11 which is interposed between the large-linewidth and small-linewidth electric conductor plates 12 and 13.

Figure 9:
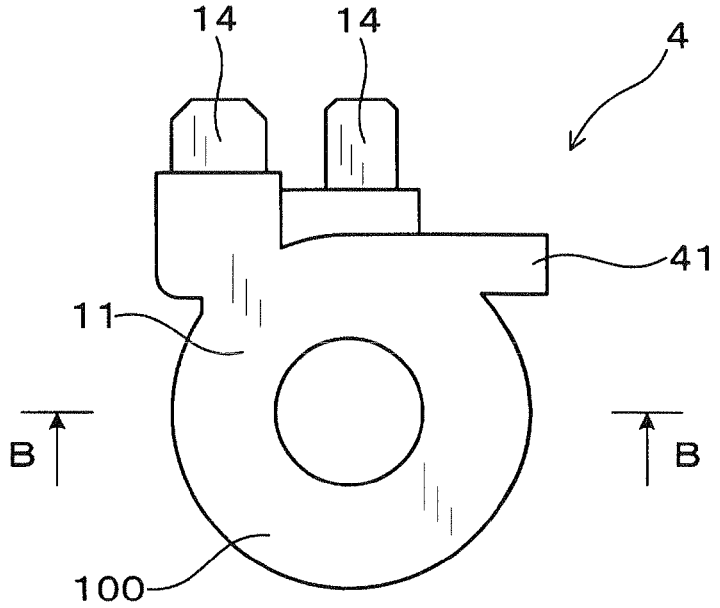
FIG. 9 is a plan view of the coil sheet which is folded to have the pair of the integrated bodies superposed.
Figure 10:
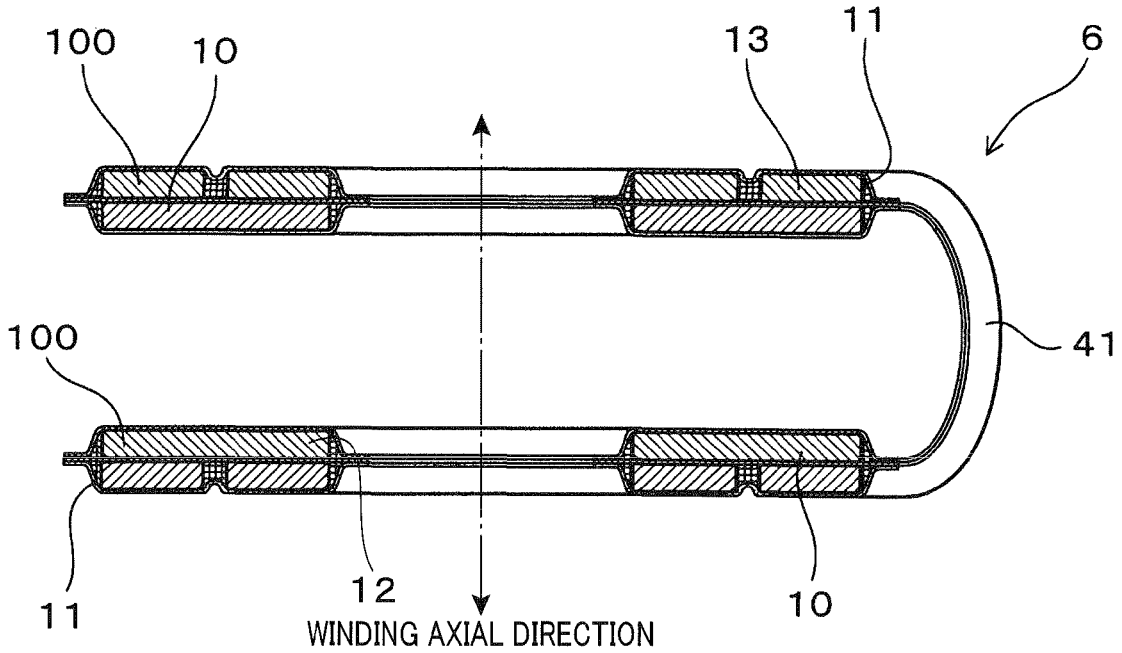
FIG. 10 is a cross-sectional view taken along the line B-B in FIG. 9.

Referring to FIGS. 5-8, in the present embodiment, the pair of integrated bodies 100 are formed of a coil sheet 4. More specifically, in the coil sheet 4, the two integrated bodies 100 are connected with each other via a connecting portion 41. As shown in FIGS. 9 and 10, the connecting portion 41 of the coil sheet 4 is folded in the thickness direction thereof, thereby superposing the integrated bodies 100 in the winding axial direction.

Moreover, as shown in FIG. 8, the connecting portion 41 of the coil sheet 4 includes therein a connecting electric conductor 411 that connects the first coils 10 included in the respective integrated bodies 100. More specifically, in the present embodiment, the connecting electric conductor 411 is integrally formed with the small-linewidth electric conductor plates 13 of the first coils 10 into one piece. In other words, the connecting electric conductor 411 is punched out of the same metal plate as the small-linewidth electric conductor plates 13.

In the present embodiment, all of the large-linewidth electric conductor plates 12, the small-linewidth electric conductor plates 13 and the connecting electric conductor 411 have substantially the same thickness. Further, the thickness of those plates 12, 13 and 411 is smaller than the thickness of those metal plates of which the second coils 20 are formed. More specifically, the thickness of the plates 12, 13 and 411 is in the range of 0.3 to 0.5 mm, while the thickness of the metal plates forming the second coils 20 is in the range of 1 to 2 mm.

Figure 5:
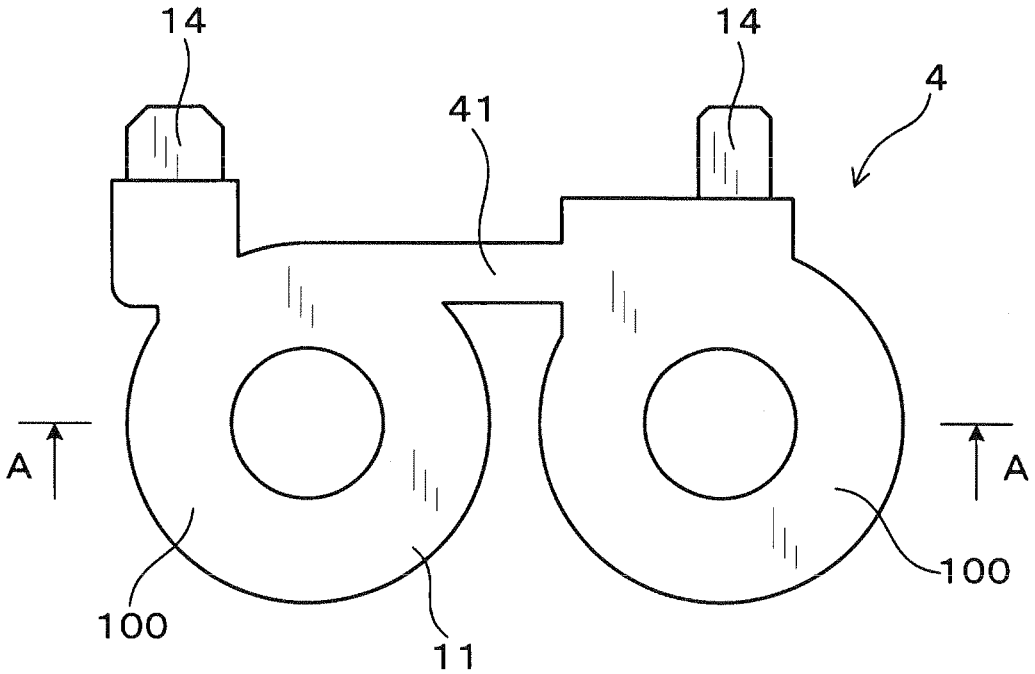
FIG. 5 is a plan view of a coil sheet, of which a pair of the integrated bodies is formed, before being folded.
Figure 6:
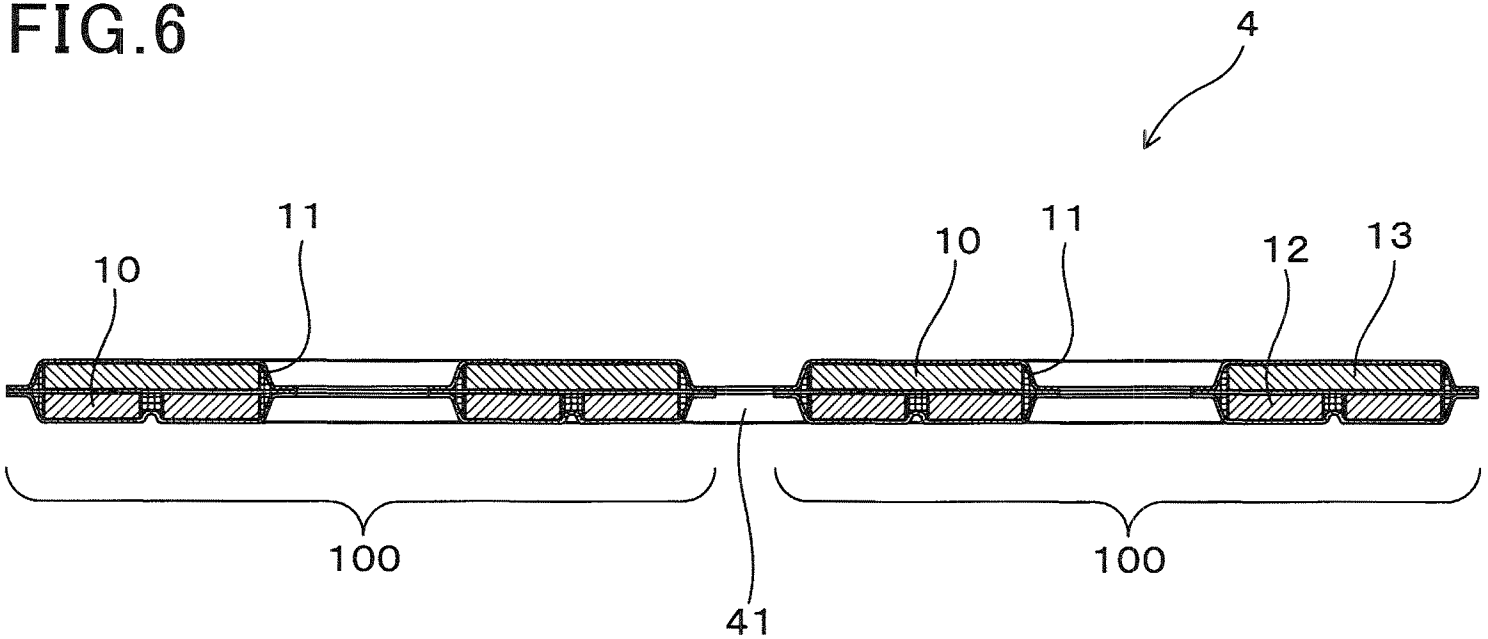
FIG. 6 is a cross-sectional view taken along the line A-A in FIG. 5.

As shown in FIG. 5, in the coil sheet 4, there are provided two coil terminals 14 that protrude respectively from the integrated bodies 100 in a direction perpendicular to both the winding axial direction and the extending direction (or the longitudinal direction) of the connecting portion 41. Moreover, both the coil terminals 14 protrude toward the same side in the direction and are both exposed from the insulating films 11. Further, as shown in FIG. 7, both the coil terminals 14 are integrally formed with the large-linewidth electric conductor plates 12 of the first coils 10 into one piece. In other words, both the coil terminals 14 are punched out of the same metal plate as the large-linewidth electric conductor plates 12. In addition, the coil terminals 14 respectively make up a pair of input terminals of the transformer 1.

The insulating films 11 together completely cover the first coils 10 except for the coil terminals 14. More specifically, the insulating films 11 cover not only the major surfaces of the first coils 10 which are perpendicular to the winding axial direction (or to the thickness direction of the large-linewidth and small-linewidth electric conductor plates 12 and 13), but also the radially inner and outer surfaces of the first coils 10. Moreover, the connecting electric conductor 411 that connects the first coils 10 is also completely covered by an insulating film 11. In addition, the insulating films 11 are made of an electrically insulative resin, such as a polyimide resin and an epoxy resin.

As described previously, for each of the first coils 10, the total number of turns of the first coil 13 is equal to 3. Moreover, the two first coils 10 are electrically connected in series with each other via the connecting electric conductor 411. Therefore, the total number of turns of the first coils 10 is equal to 6. In addition, as shown in FIGS. 9 and 10, after the two integrated bodies 100 are brought into superposition by folding the coil sheet 4 at the connecting portion 41, the winding directions of the first coils 10 are the same.

Referring back to FIGS. 2 and 4, each of the second coils 20 is formed by punching a metal plate into a substantially annular shape. Consequently, for each of the second coils 20, the number of turns of the second coil 20 is equal to 1. Moreover, the two second coils 20 are superposed with a gap formed therebetween in the winding axial direction (or in the thickness direction of the second coils 20). Further, as will be described in detail later, the two second coils 20 are electrically connected to each other. Consequently, the total number of turns of the two second coils 20 is equal to 2.

In the present embodiment, the diameter of the second coils 20 is set to be smaller than that of the integrated bodies 100 so that the radially outer peripheries 20*a* of the second coils 20 are positioned radially inside of the radially outer peripheries 11*a* of the insulating films 11 and the radially inner peripheries 20*b* of the second coils 20 are positioned radially outside of the radially inner peripheries 11*b* of the insulating films 11. That is, the second coils 20 protrude neither radially outward nor radially inward from the insulating films 11 of the integrated bodies 100. In addition, when viewed along the winding axial direction, the radially outer peripheries 20*a* of the second coils 20 substantially coincide with the radially outer peripheries of the first coils 10 and the radially inner peripheries 20*b* of the second coils 20 substantially coincide with the radially inner peripheries of the first coils 10.

Figure 11:
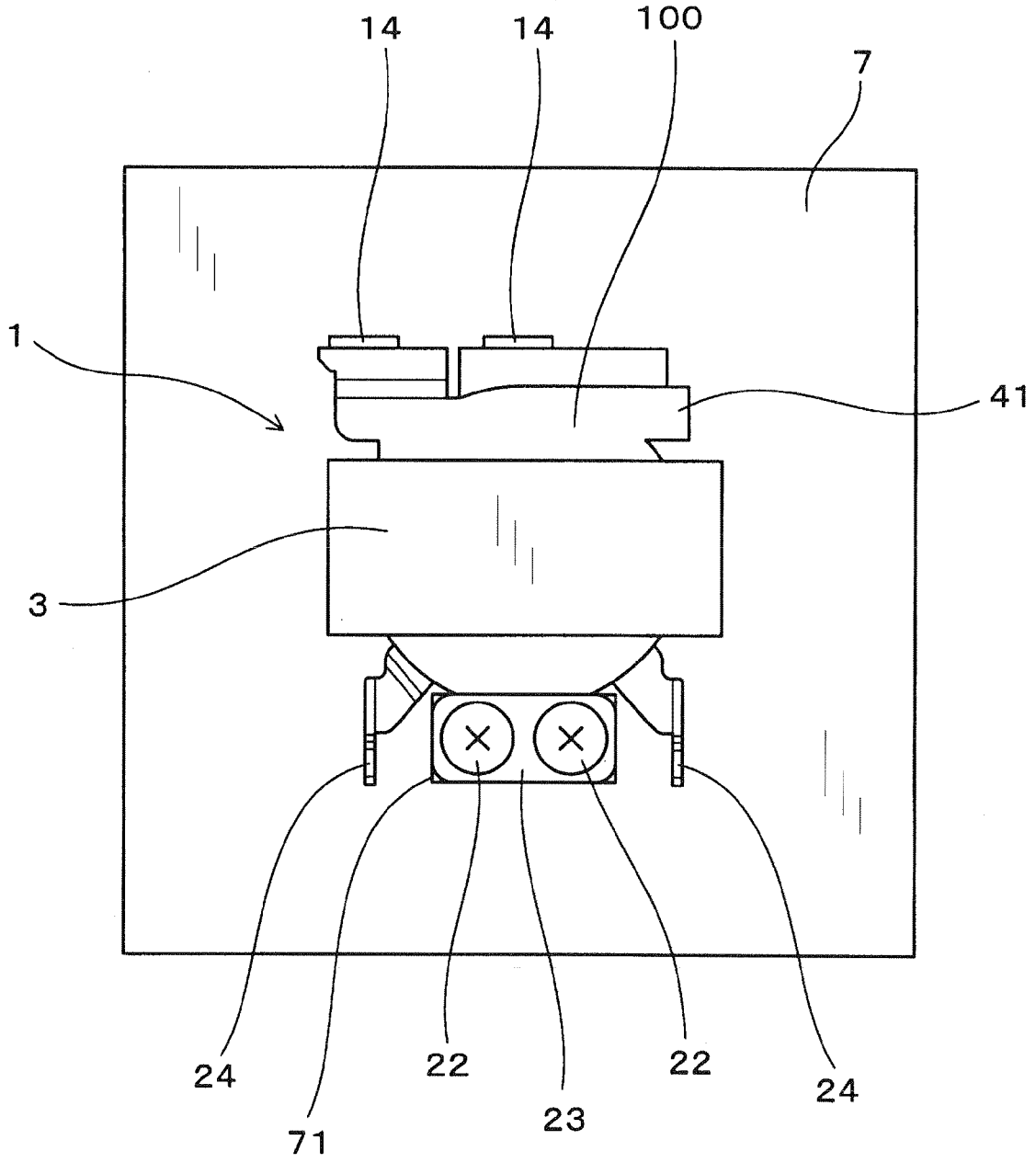
FIG. 11 is a plan view illustrating the transformer which is mounted on a heat sink.
Figure 12:
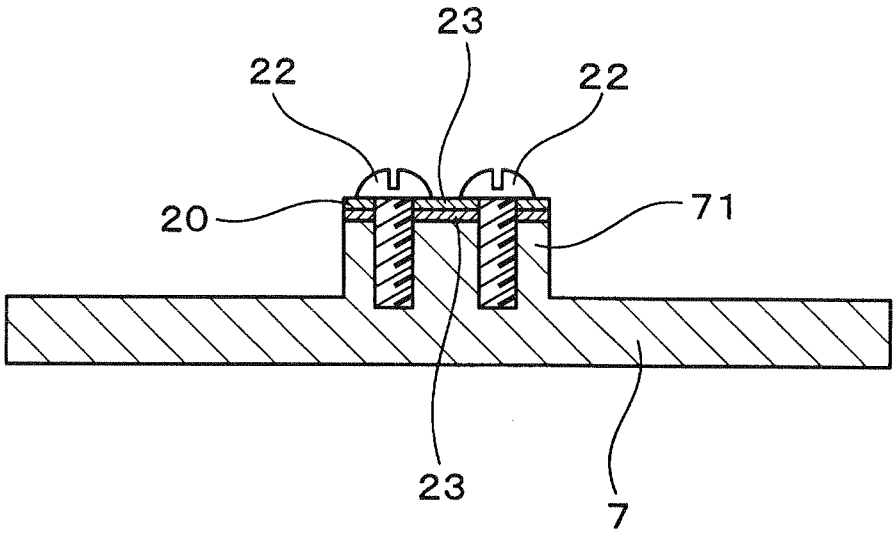
FIG. 12 is a cross-sectional view illustrating connecting terminals of a pair of second coils of the transformer, the connecting terminals being fixed to a terminal block of the heat sink.

Moreover, in the present embodiment, as shown in FIG. 11, the transformer 1 is mounted on a heat sink 7. Further, as shown in FIG. 12, the second coils 20 of the transformer 1 are thermally connected to the heat sink 7.

More specifically, each of the second coils 20 has a connecting terminal 23 and a coil terminal 24 that protrude from the substantially-annular main body of the second coil 20. The connecting terminals 23 of the second coils 20 are superposed and aligned with each other, and fixed to a terminal block 71 of the heat sink 7 by means of a pair of screws 22. Consequently, the second coils 20 are electrically connected to each other at the connecting terminals 23; they are also fixed to and thereby thermally connected to the heat sink 7 at the connecting terminals 23. In addition, the heat sink 7 may be implemented by a wall portion of a cooler that has formed therein a coolant passage for circulating a coolant.

Moreover, the second coils 20 are also mechanically connected to each other at the connecting terminals 23, thereby becoming one integrated body. Further, the coil terminals 24 of the second coils 20 respectively make up a pair of output terminals of transformer 1. In addition, both the connecting terminals 23 of the second coils 20 are grounded via the heat sink 7.

As shown in FIG. 11, when viewed along the winding axial direction, all of the connecting terminals 23 and coil terminals 24 of the second coils 20 protrude from the respective substantially-annular main bodies of the second coils 20 on the same side of the core 3.

Further, when viewed along the winding axial direction, the connecting terminals 23 and coil terminals 24 of the second coils 20 protrude on the opposite side of the core 3 to the coil terminals 14 of the first coils 10.

Furthermore, as shown in FIGS. 1 and 2, the first coils 10 and the second coils 20 are stacked so that the large-linewidth electric conductor plates 12 respectively face the second coils 20. In other words, the integrated bodies 100 are arranged so that the large-linewidth electric conductor plates 12 are respectively in contact with the second coils 20 via the insulating films 11 interposed therebetween.

Next, the advantages of the transformer 1 according to the present embodiment will be described.

In the present embodiment, the transformer 1 includes the pair of first coils 10 and the pair of second coils 20 that are stacked so that the pair of second coils 20 is interposed between the first coils 10 in the common winding axial direction of the first and second coils 10 and 20. Each of the first coils 10 is covered by the insulating films 11 and integrated with the insulating films 11 into one integrated body 100, so that the first coils 10 are electrically insulated from the second coils 20.

With the above configuration, electrical insulation between the first coils 10 and the second coils 20 is secured by means of the thin insulating films 11 that cover the first coils 10. Moreover, since the pair of second coils 20 is interposed between the first coils 10 in the winding axial direction, the second coils 20 are prevented from making contact with the core pieces 30 that are arranged with the stacked body 6 of the first and second coils 10 and 20 interposed therebetween in the winding axial direction. Consequently, electrical insulation between the second coils 20 and the core pieces 30 is secured without employing any additional insulating means. In addition, electrical insulation between the first coils 10 and the core pieces 30 is also secured by means of the thin insulating films 11 that cover the first coils 10.

As a result, it becomes possible to secure the electrical insulation between the first coils 10, the second coils 20 and the core pieces 30 without employing bobbins and thus without increasing the size of the transformer 1. Moreover, since each of the first coils 10 is integrated with the insulating films 11 into one integrated body 100, the parts count of the transformer 1 is prevented from increasing and the assembly process of the transformer 1 is prevented from becoming complicated.

Accordingly, with the above configuration, it is possible to minimize both the size and parts count of the transformer 1 and simplify the assembly process of the transformer 1 while securing the electrical insulation between the first coils 10, the second coils 20 and the core pieces 30 without employing bobbins.

Further, in the present embodiment, each of the first coils 10 is comprised of the large-linewidth electric conductor plate 12 and the small-linewidth electric conductor plate 13 that are stacked in the winding axial direction with one insulating film 11 interposed therebetween. In addition, the large-linewidth and small-linewidth electric conductor plates 12 and 13 can be considered as the coil segments that together make up the first coil 10.

With the above configuration, it is possible to increase the number of turns of each of the first coils 10 without unnecessarily increasing the thickness of each of the first coils 10 in the winding axial direction.

More specifically, if each of the first coils 10 was made up of a single electric conductor plate that is spiral-shaped as the small-linewidth electric conductor plate 13 shown in FIG. 8, it would be necessary to lead out the coil terminal 14 or the connecting electric conductor 411 from the radially inner end of the single electric conductor plate in the winding axial direction. Consequently, a certain thickness in the winding axial direction would be sacrificed only for the purpose of leading out the coil terminal 14 or the connecting electric conductor 411. In comparison, in the present embodiment, each of the first coils 10 is comprised of the large-linewidth and small-linewidth electric conductor plates 12 and 13 that are stacked in the winding axial direction; that end of the large-linewidth electric conductor plate 12 which does not make up the coil terminal 14 is electrically connected to the radially inner end of the small-linewidth electric conductor plate 13. Consequently, no thickness in the winding axial direction is sacrificed only for the purpose of leading out the coil terminal 14 or the connecting electric conductor 411.

In the present embodiment, the integrated bodies 100 and the second coils 20 are each substantially annular-shaped. Moreover, the diameter of the second coils 20 is set to be less than that of the integrated bodies 100 so that the radially outer peripheries 20*a* of the second coils 20 are positioned radially inside of the radially outer peripheries 11*a* of the insulating films 11 and the radially inner peripheries 20*b* of the second coils 20 are positioned radially outside of the radially inner peripheries 11*b* of the insulating films 11.

With the above configuration, the second coils 20 protrude neither radially outward nor radially inward from the insulating films 11 of the integrated bodies 100. Consequently, the second coils 20 are prevented from making contact with the center magnetic legs 31 of the core pieces 30 located on the radially inside of the insulating films 11 and the side magnetic legs 32 of the core pieces 30 located on the radially outside of the insulating films 11. As a result, the electrical insulation between the second coils 20 and the core pieces 30 can be reliably secured.

In the present embodiment, both the integrated bodies 100 are formed of the coil sheet 4, in which the integrated bodies 100 are connected with each other via the connecting portion 41. The coil sheet 4 is folded at the connecting portion 41 so that the integrated bodies 100 are superposed in the winding axial direction. Moreover, the connecting portion 41 of the coil sheet 4 includes therein the connecting electric conductor 411 that connects the first coils 10 included in the respective integrated bodies 100.

With the above configuration, it is possible to easily form both the integrated bodies 100 at the same time by stacking the large-linewidth and small-linewidth electric conductor plates 12 and 13 and the insulating films 11. Moreover, it is possible to easily handle both the integrated bodies 100 as a single part during the assembly process of the transformer 1. In addition, it is possible to easily make the electrical connection between the first coils 100 included in the respective integrated bodies 100.

In the present embodiment, in the coil sheet 4, there are provided the two coil terminals 14 that protrude respectively from the integrated bodies 100 in the direction perpendicular to both the winding axial direction and the extending direction of the connecting portion 41.

With the above configuration, it is possible to improve the degree of freedom in setting the shape and the protruding amount of the coil terminals 14. In other words, it is possible to improve the design freedom of the coil terminals 14.

In the present embodiment, each of the first coils 10 is comprised of the large-linewidth electric conductor segment 12 and the small-linewidth electric conductor segment 13 that are stacked in the winding axial direction. The second coils 20 are directly thermally connected to the heat sink 7. The first and second coils 10 and 20 are stacked so that the large-linewidth electric conductor plates 12 of the first coils 10 respectively face the second coils 20.

With the above configuration, the heat transfer area between the first coils 10 and the second coils 20 is increased in comparison with a case where the small-linewidth electric conductor plates 13 are arranged to respectively face the second coils 20. Consequently, it is possible to more effectively dissipate heat generated by the first coils 10 via the second coils 20 and the heat sink 7.

In the present embodiment, as shown in FIG. 11, when viewed along the winding axial direction, the connecting terminals 23 and coil terminals 24 of the second coils 20 protrude on the opposite side of the core 3 to the coil terminals 14 of the first coils 10.

With the above configuration, it is possible to more reliably secure the electrical insulation between the first coils 10 and the second coils 20.

Further, in the present embodiment, when viewed along the winding axial direction, all of the connecting terminals 23 and coil terminals 24 of the second coils 20 protrude on the same side of the core 3.

With the above configuration, it is possible to easily form the main bodies of the second coils 20 into the substantially annular shape, thereby securing a high yield rate of the second coils 20.

[Second Embodiment]

This embodiment illustrates a transformer 1 which has almost the same configuration as the transformer 1 according to the first embodiment; accordingly, only the differences therebetween will be described hereinafter.

Figure 13:
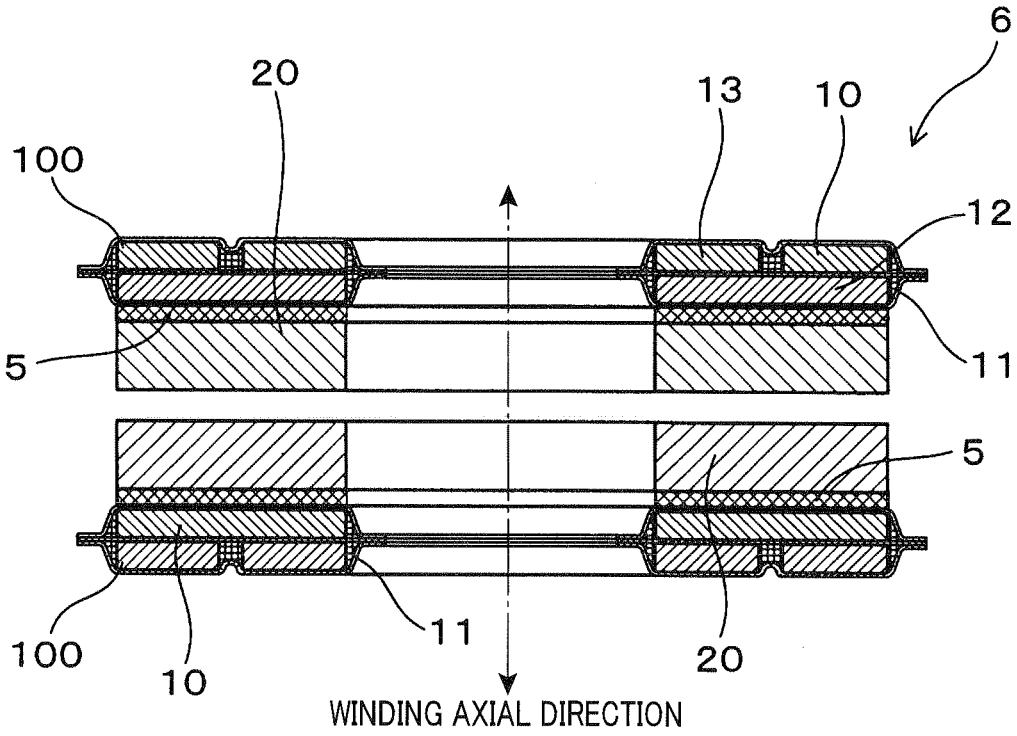
FIG. 13 is a cross-sectional view of a stacked body according to a second embodiment.

In the present embodiment, as shown in FIG. 13, each of the second coils 20 is bonded by an adhesive 5 to that one of the integrated bodies 100 which is adjacent to the second coil 20.

Figure 14:
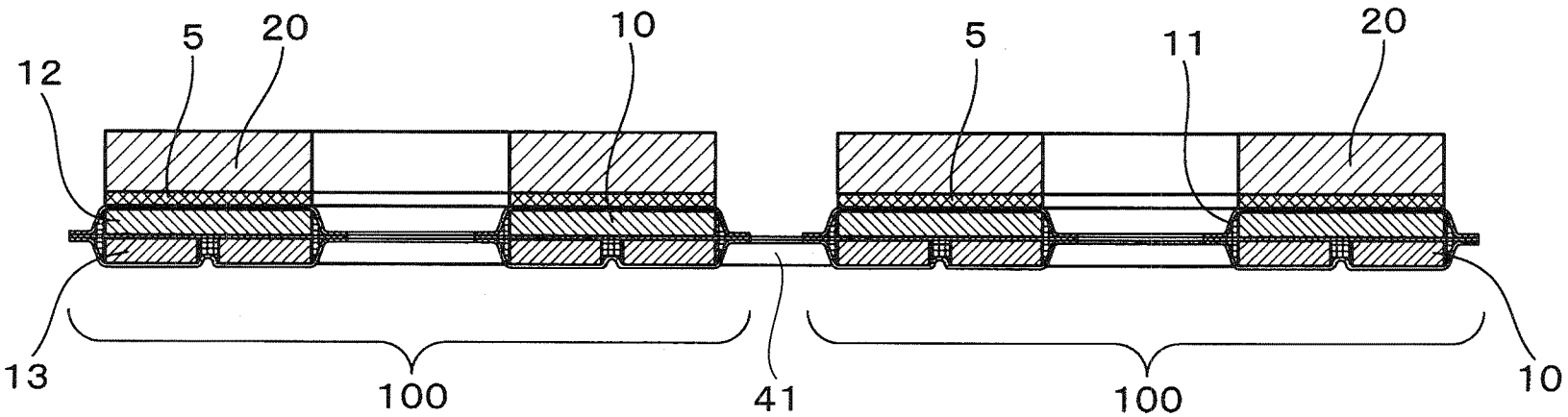
FIG. 14 is a cross-sectional view of a coil sheet according to the second embodiment before being folded, wherein a pair of second coils is bonded to the coil sheet.

More specifically, in the present embodiment, as shown in FIG. 14, on one major surface of the coil sheet 4, the second coils 20 are respectively bonded by the adhesive 5 to the corresponding integrated bodies 100. Then, the coil sheet 4 is folded at the connecting portion 41 so that the second coils 20 are superposed and face each other in the winding axial direction. Consequently, as shown in FIG. 13, in the resultant stacked body 6, the pair of second coils 20 is interposed between the integrated bodies 100 in the winding axial direction. Thereafter, the stacked body 6 and the core 3 are assembled together so that the stacked body 6 is interposed between and thereby covered by the core pieces 30 of the core 3 in the winding axial direction (see FIGS. 1 and 4). As a result, the transformer 1 according to the present embodiment is obtained.

The above-described transformer 1 according to the present embodiment has the same advantages as the transformer 1 according to the first embodiment.

In addition, in the present embodiment, since the second coils 20 are respectively bonded by the adhesive 5 to the corresponding integrated bodies 100, it is possible to easily handle all of the integrated bodies 100 and the second coils 20 as a single part during the process of assembling the stacked body 6 and the core 3. Further, it is also possible to more effectively dissipate heat generated by the first coils 10 via the second coils 20 and the heat sink 7.

[Third Embodiment]

This embodiment illustrates a transformer 1 which has almost the same configuration as the transformer 1 according to the first embodiment; accordingly, only the differences therebetween will be described hereinafter.

Figure 15:
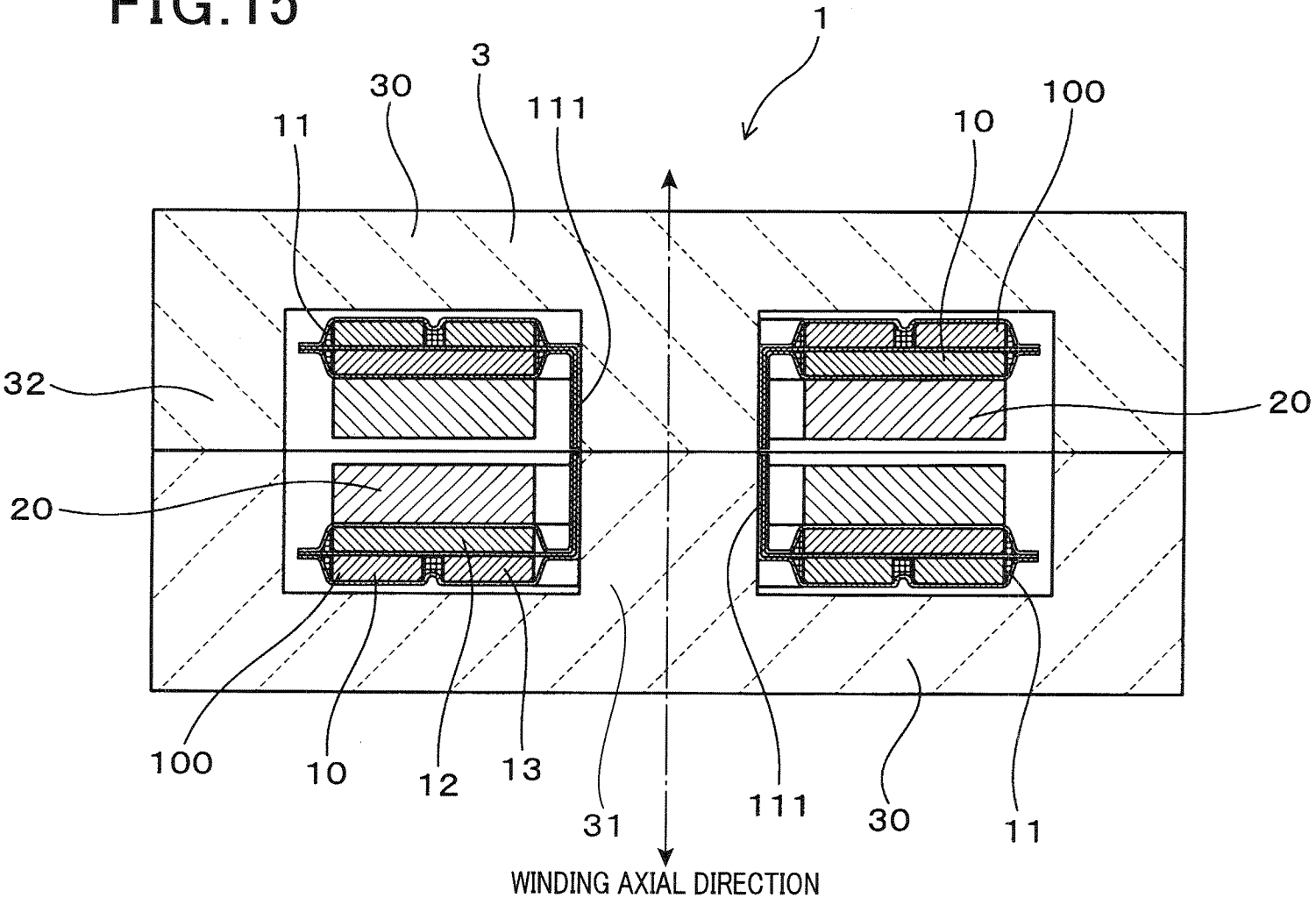
FIG. 15 is a cross-sectional view illustrating the overall configuration of a transformer according to a third embodiment.

In the present embodiment, as shown in FIG. 15, the insulating films 11, which cover the first coils 10, have extensions 111 that extend in the winding axial direction along the outer surfaces of the center magnetic legs 31 of the core pieces 30 of the core 3, so as to be radially interposed between the outer surfaces of the center magnetic legs 31 and the radially inner surfaces of the second coils 20.

Figure 16:
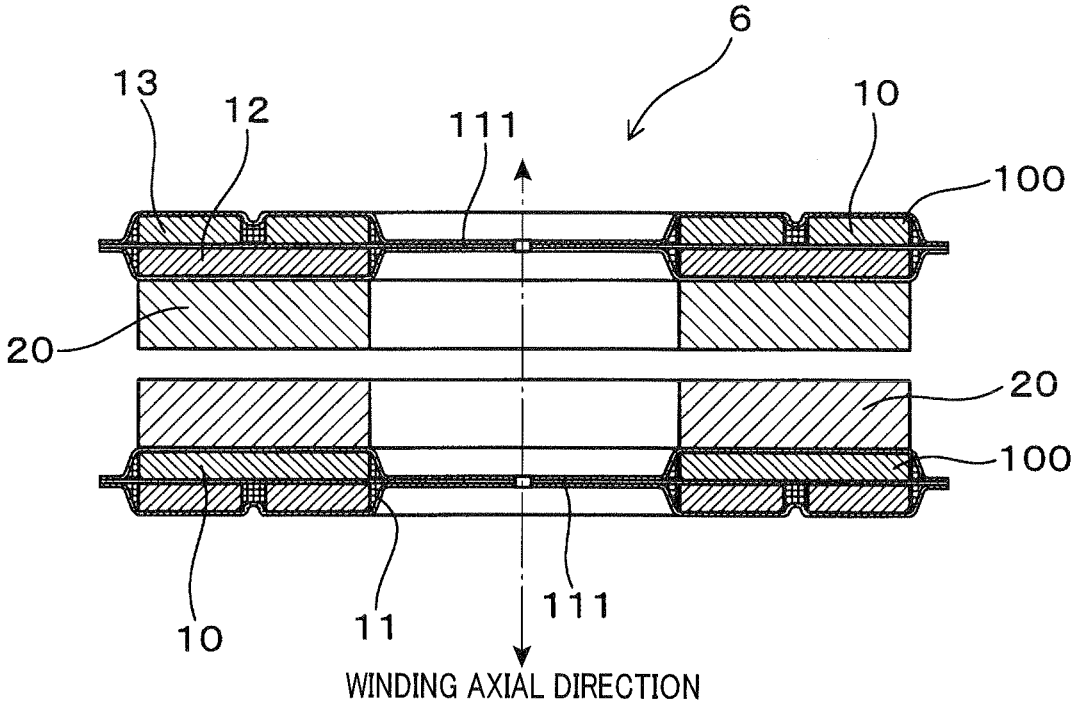
FIG. 16 is a cross-sectional view of a stacked body of the transformer according to the third embodiment.
Figure 17:
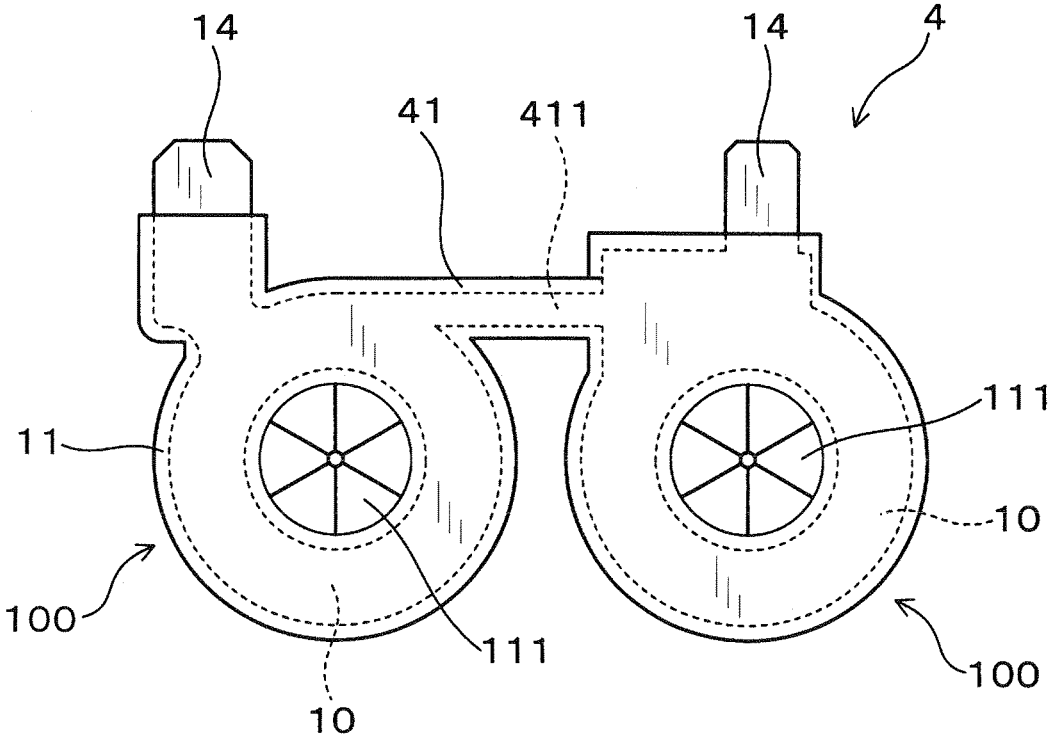
FIG. 17 is a plan view of a coil sheet according to the third embodiment before being folded.

More specifically, in the present embodiment, as shown in FIG. 17, during the formation of the integrated bodies 100, the insulating films 11 are applied so as to have center portions that extend radially inward from the radially inner surfaces of the first coils 10 to close the openings formed on the radially inside of the first coils 10. Then, the center portions are radially cut into a plurality of pieces. Thereafter, the coil sheet 4 is folded at the connecting portion 41 to superpose the integrated bodies 100 in the winding axial direction; further, the second coils 20 are stacked with the integrated bodies 100 in the winding axial direction to form the stacked body 6 as shown in FIG. 16. Next, the stacked body 6 and the core 3 are assembled together to form the transformer 1 as shown in FIG. 15. During the assembly of the stacked body 6 and the core 3, the center magnetic legs 31 of the core pieces 30 of the core 3 are inserted into the radially inner space of the stacked body 6, pressing the pieces of the center portions of the insulating films 11. Consequently, by the pressing force of the center magnetic legs 31, the pieces of the center portions of the insulating films are deformed to extend in the winding axial direction along the outer surfaces of the center magnetic legs 31, thereby making up the extensions 111.

The above-described transformer 1 according to the present embodiment has the same advantages as the transformer 1 according to the first embodiment.

In addition, in the present embodiment, with the extensions 111 of the insulating films 11 radially interposed between the outer surfaces of the center magnetic legs 31 of the core pieces 30 and the radially inner surfaces of the second coils 20, it is possible to more reliably secure the electrical insulation between the second coils 20 and the core pieces 30 of the core 3.

[Fourth Embodiment]

This embodiment illustrates a transformer 1 which has almost the same configuration as the transformer 1 according to the first embodiment; accordingly, only the differences therebetween will be described hereinafter.

Figure 18:
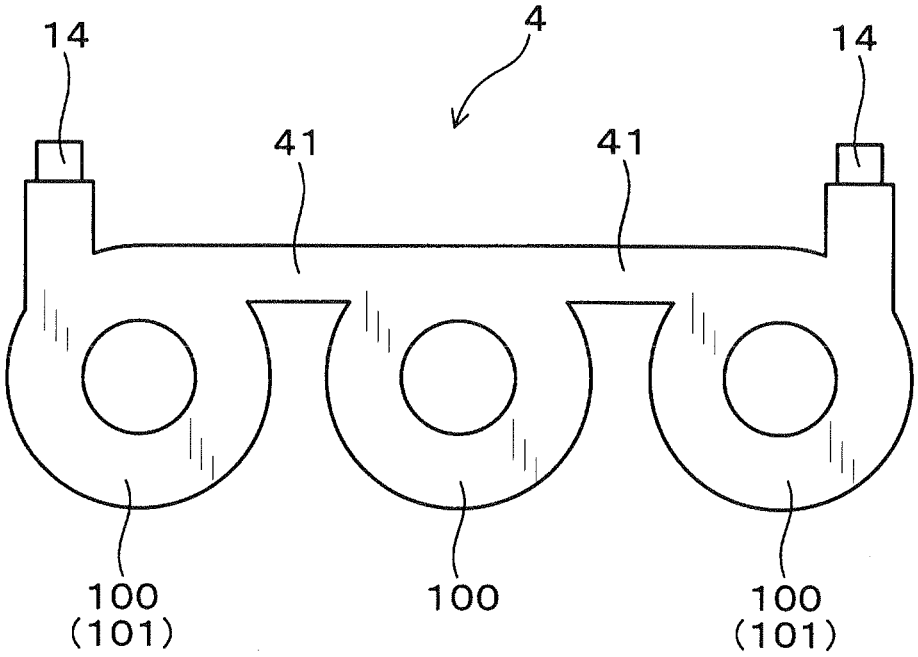
FIG. 18 is a plan view of a coil sheet according to a fourth embodiment before being folded.

In the present embodiment, as shown in FIG. 18, the coil sheet 4 includes three integrated bodies 100 that are connected to one another via a pair of connecting portions 41 and aligned with each other in a direction parallel to the extending direction of the connecting portions 41. Moreover, the pair of coil terminals 14 are arranged so as to protrude, in a direction perpendicular to both the winding axial direction and the extending direction of the connecting portions 41, respectively from those two of the integrated bodies 100 which are respectively located at opposite ends of the coil sheet 4. In addition, both the coil terminals 14 protrude toward the same side in the direction perpendicular to both the winding axial direction and the extending direction of the connecting portions 41.

Figure 19:
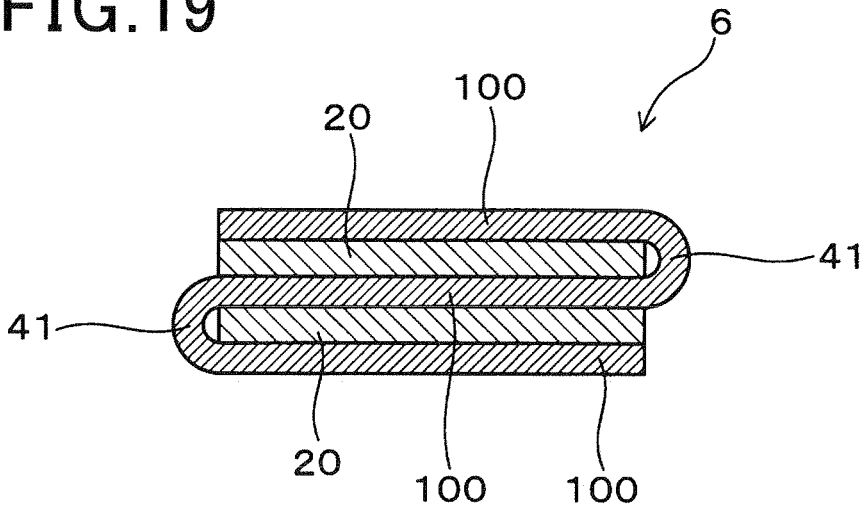
FIG. 19 is a cross-sectional view of a stacked body according to the fourth embodiment.

Furthermore, as shown in FIG. 19, the coil sheet 4 is folded twice at the connecting portions 41 so that the integrated bodies 100 are superposed in the winding axial direction. Then, each of the second coils 20 is inserted between an adjacent pair of the integrated bodies 100. Consequently, the integrated bodies 100 are alternately arranged with the second coils 20 in the winding axial direction, forming the stacked body 6. Thereafter, though not shown in the figures, the stacked body 6 and the core 3 are assembled together to form the transformer 1 according to the present embodiment.

The above-described transformer 1 according to the present embodiment has the same advantages as the transformer 1 according to the first embodiment.

Figure 20:
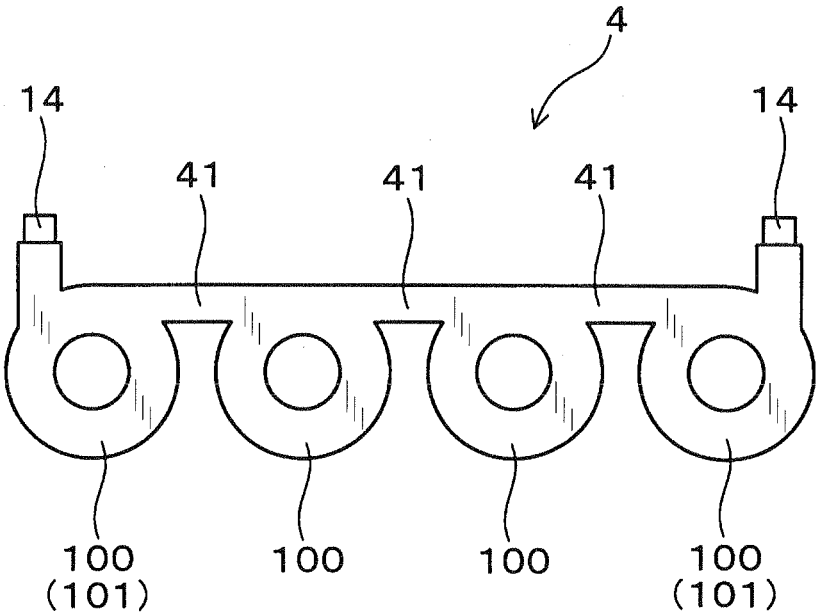
FIG. 20 is a plan view of a coil sheet according to a first modification of the fourth embodiment.
Figure 21:
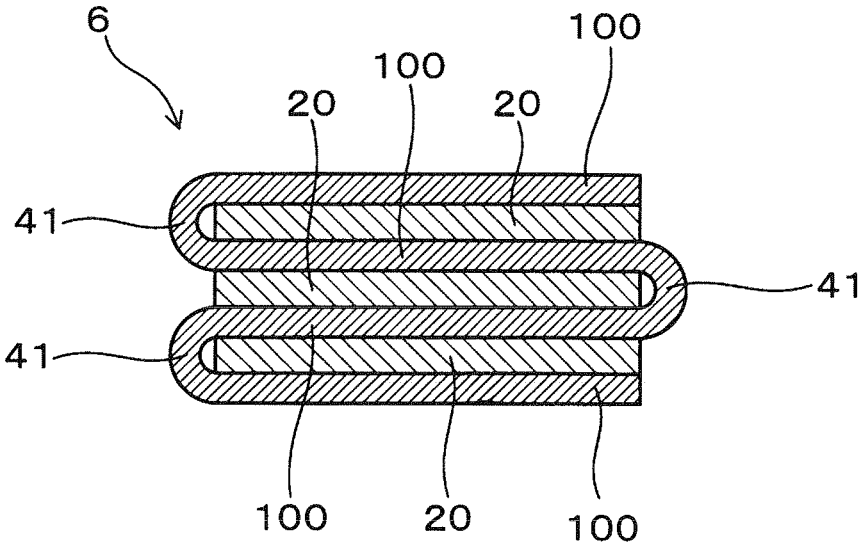
FIG. 21 is a cross-sectional view of a stacked body according to the first modification.
Figure 22:
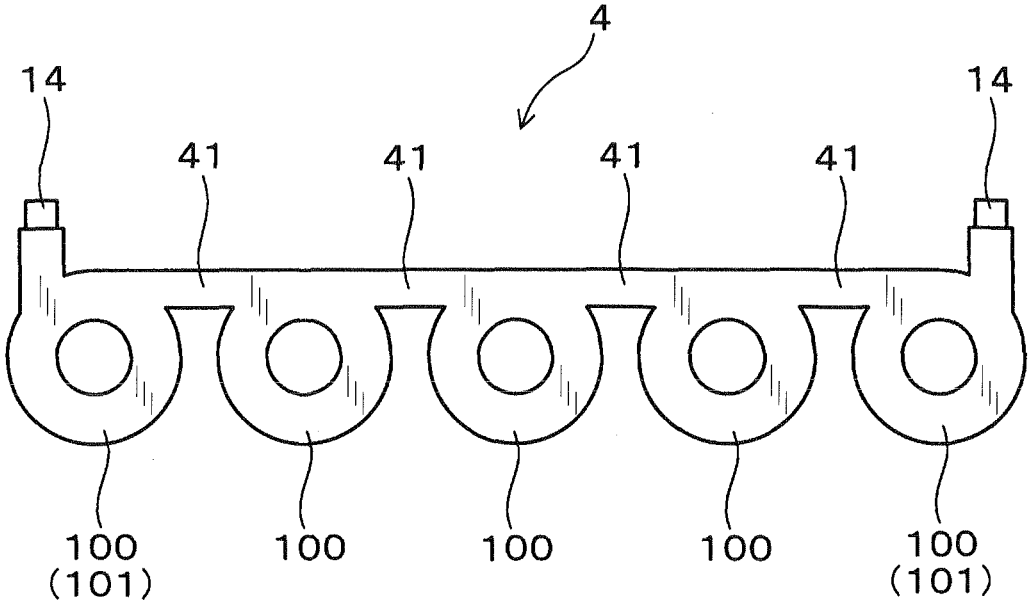
FIG. 22 is a plan view of a coil sheet according to a second modification of the fourth embodiment.
Figure 23:
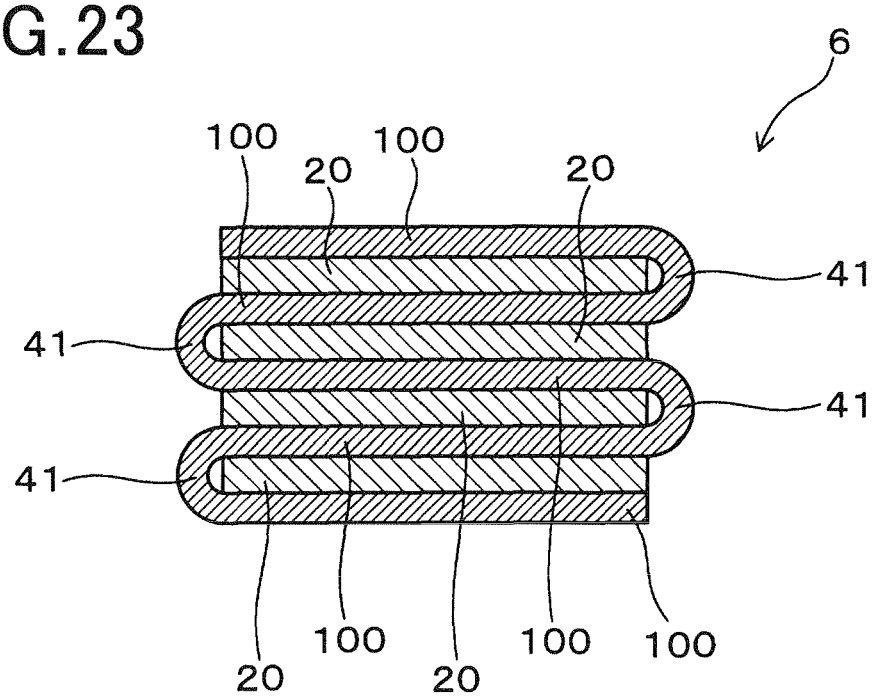
FIG. 23 is a cross-sectional view of a stacked body according to the second modification.

In addition, the number of the integrated bodies 100 may be suitably set according to the design specification of the transformer 1. For example, in one modification of the present embodiment, as shown in FIGS. 20 and 21, the coil sheet 4 includes four integrated bodies 100 that are connected to one another via three connecting portions 41. In another modification, as shown in FIGS. 22 and 23, the coil sheet 4 includes five integrated bodies 100 that are connected to one another via four connecting portions 41.

[Fifth Embodiment]

This embodiment illustrates a transformer 1 which has almost the same configuration as the transformer 1 according to the first embodiment; accordingly, only the differences therebetween will be described hereinafter.

In the first embodiment, the transformer 1 includes only the single stacked body 6, in which the pair of second coils 20 is interposed between the integrated bodies 100 in the winding axial direction (see FIG. 2).

Figure 24:
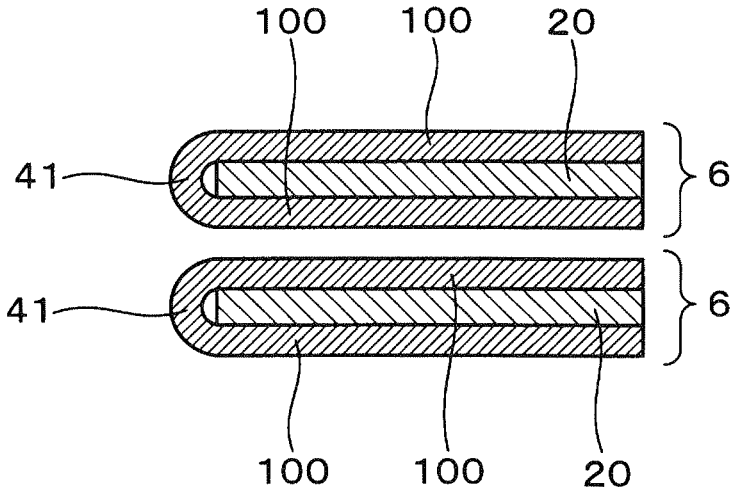
FIG. 24 is a cross-sectional view illustrating a pair of stacked bodies of a transformer according to a fifth embodiment.

In comparison, in the present embodiment, as shown FIG. 24, the transformer 1 includes a pair of stacked bodies 6 that are stacked in the winding axial direction. Further, in each of the stacked bodies 6, there is only a single second coil 20 interposed between two integrated bodies 100. Furthermore, the stacked bodies 6 are electrically connected with each other. More specifically, the first coils 10 included in the integrated bodies 100 of one of the stacked bodies 6 are electrically connected with the first coils 10 included in the integrated bodies 100 of the other stacked body 6; the second coils 20 of one of the stacked bodies 6 are electrically connected with the second coils 20 of the other stacked body 6.

The above-described transformer 1 according to the present embodiment has the same advantages as the transformer 1 according to the first embodiment.

In addition, in the present embodiment, each of the stacked bodies 6 can function as a transformer element. That is, two transformer elements are covered by a single core 3. Consequently, compared to the case of employing two transformers 1 each including a single transformer unit, both the size and part counts are reduced.

[Sixth Embodiment]

This embodiment illustrates a transformer 1 which has almost the same configuration as the transformer 1 according to the first embodiment; accordingly, only the differences therebetween will be described hereinafter. In the first embodiment, the transformer 1 has the pair of second coils 20 interposed between the integrated bodies 100 (or between the first coils 10) in the winding axial direction (see FIG. 1).

Figure 25:
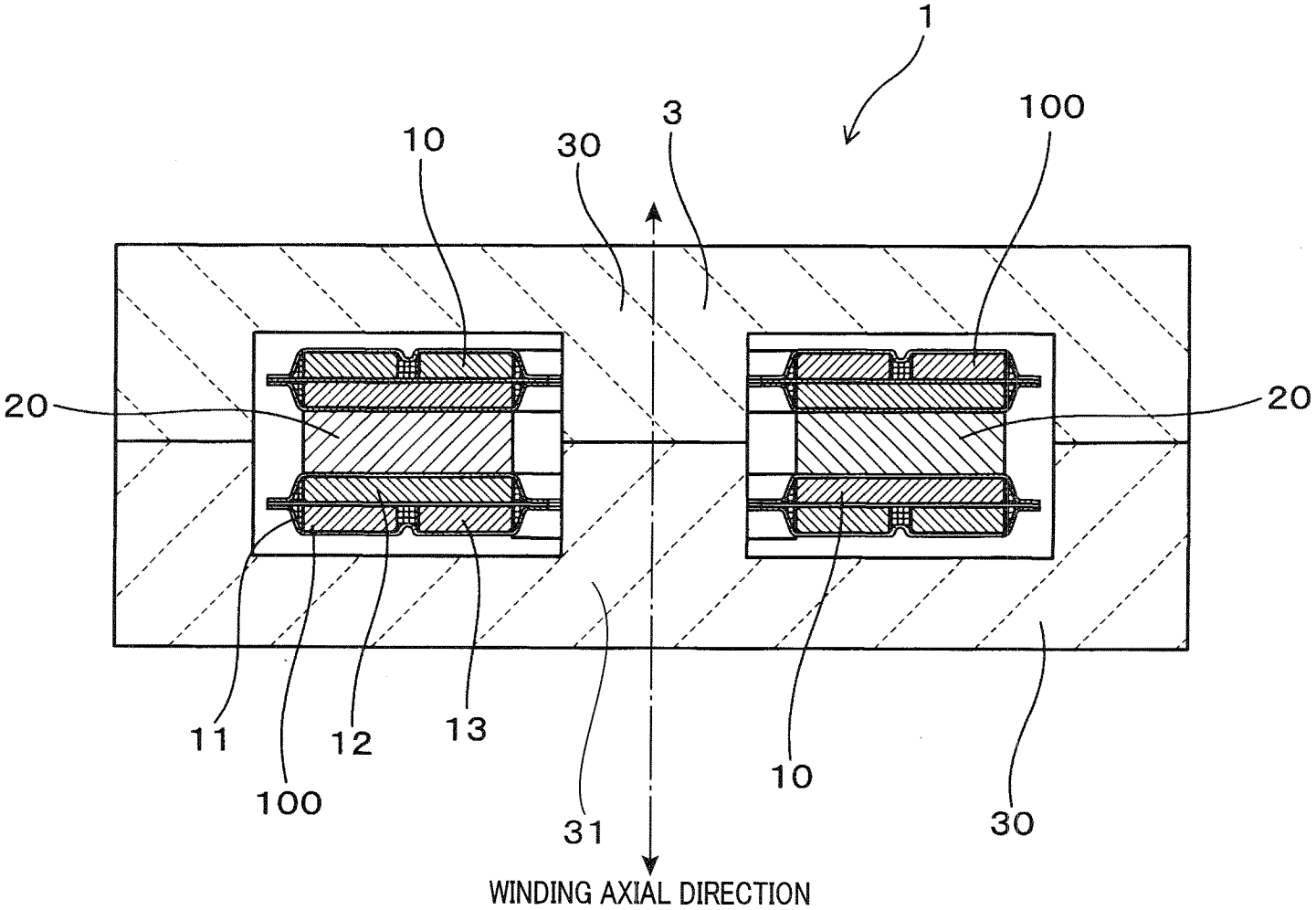
FIG. 25 is a cross-sectional view illustrating the overall configuration of a transformer according to a sixth embodiment.

In comparison, in the present embodiment, as shown FIG. 25, the transformer 1 has only a single second coil 20 interposed between the integrated bodies 100 in the winding axial direction.

The above-described transformer 1 according to the present embodiment has the same advantages as the transformer 1 according to the first embodiment.

In addition, the number of the second coils 20 interposed between the first coils 10 may be suitably set according to the design specification of the transformer 1.

[Seventh Embodiment]

This embodiment illustrates a transformer 1 which has almost the same configuration as the transformer 1 according to the fourth embodiment; accordingly, only the differences therebetween will be described hereinafter.

In the fourth embodiment, the coil sheet 4 includes three or more integrated bodies 100, but has only the pair of coil terminals 14 that protrude respectively from those two of the integrated bodies 100 which are respectively located at opposite ends of the coil sheet 4 (see FIGS. 18-23).

Figure 26:
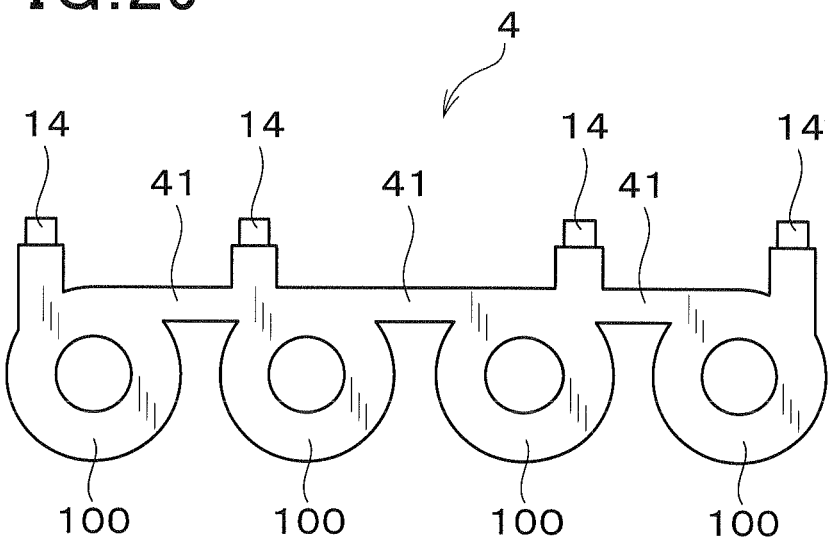
FIG. 26 is a plan view of a coil sheet according to a seventh embodiment before being folded.

In comparison, in the present embodiment, as shown FIG. 26, the coil sheet 4 includes four integrated bodies 100 that are connected to one another via three connecting portions 41 and aligned with each other a direction parallel to the extending direction of the connecting portions 41. Moreover, the coil sheet 4 has four coil terminals 14 that protrude respectively from the integrated bodies 100 in a direction perpendicular to both the winding axial direction and the extending direction of the connecting portions 41. In other words, for each of the integrated bodies 100, there is provided one coil terminal 14 that protrudes from the integrated body 100. In addition, all the coil terminals 14 protrude toward the same side in the direction perpendicular to both the winding axial direction and the extending direction of the connecting portions 41.

The above-described transformer 1 according to the present embodiment has the same advantages as the transformer 1 according to the fourth embodiment.

In addition, in the present embodiment, by providing more than two coil terminals 14 in the coil sheet 4, it is possible to easily form one or more center taps of the transformer 1.

It should be noted that the number of the coil terminals 14 may be suitably set according to the design specification of the transformer 1.

[Eighth Embodiment]

This embodiment illustrates a transformer 1 which has almost the same configuration as the transformer 1 according to the first embodiment; accordingly, only the differences therebetween will be described hereinafter.

In the first embodiment, each of the integrated bodies 100 is formed in the shape of a substantially circular ring (see FIG. 5).

Figure 27:
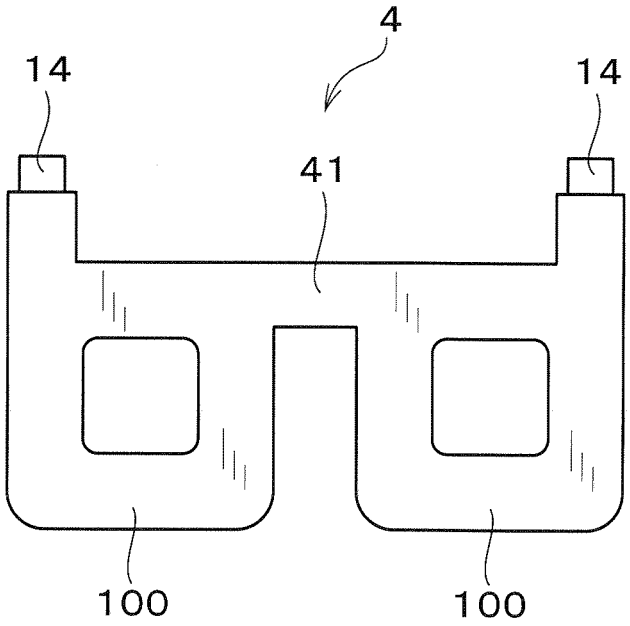
FIG. 27 is a plan view of a coil sheet according to an eighth embodiment before being folded.

In comparison, in the present embodiment, as shown FIG. 27, each of the integrated bodies 100 is formed in the shape of a substantially rectangular ring. In addition, though not shown in the figures, each of the first coils 10 and the second coils 20 is also formed in the shape of a substantially rectangular ring.

The above-described transformer 1 according to the present embodiment has the same advantages as the transformer 1 according to the first embodiment.

In addition, the integrated bodies 100 may also have other shapes, for example, the shape of a substantially elliptical or hexagonal ring.

[Ninth Embodiment]

This embodiment illustrates a transformer 1 which has almost the same configuration as the transformer 1 according to the first embodiment; accordingly, only the differences therebetween will be described hereinafter.

In the first embodiment, the two coil terminals 14 protrude respectively from the integrated bodies 100 in a direction perpendicular to both the winding axial direction and the extending direction of the connecting portion 41. Moreover, both the coil terminals 14 protrude toward the same side in the direction (see FIG. 5).

Figure 28:
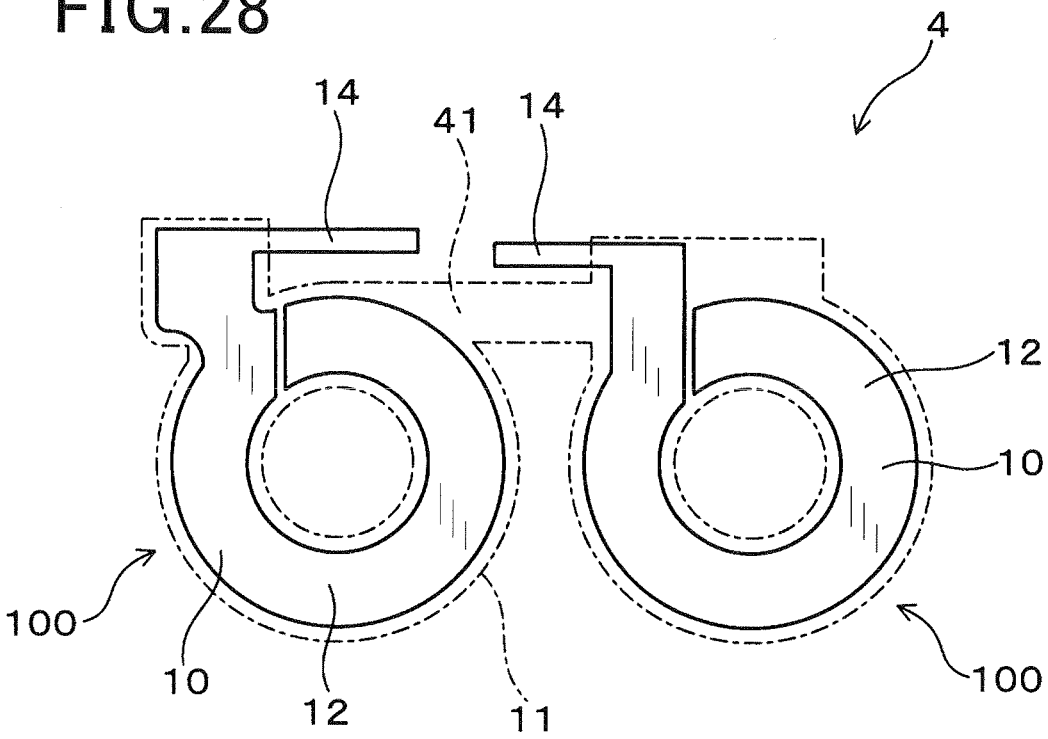
FIG. 28 is a plan view of a coil sheet according to a ninth embodiment before being folded.

In comparison, in the present embodiment, as shown FIG. 28, the two coil terminals 14 protrude respectively from the integrated bodies 100 in a direction parallel to the extending direction of the connecting portion 41. Moreover, the two coil terminals 14 protrude toward each other. In addition, it should be noted that the two coil terminals 14 may also be arranged to protrude toward the same side or toward opposite sides in the direction parallel to the extending direction of the connecting portion 41.

The above-described transformer 1 according to the present embodiment has the same advantages as the transformer 1 according to the first embodiment.

In addition, in the present embodiment, the two coil terminals 14 are arranged in the vicinity of the integrated bodies 100. Consequently, it is possible to secure a high yield rate in punching a single metal plate to form the coil terminals 14 and the large-linewidth electric conductor plates 12 of the integrated bodies 100.

Figure 29:
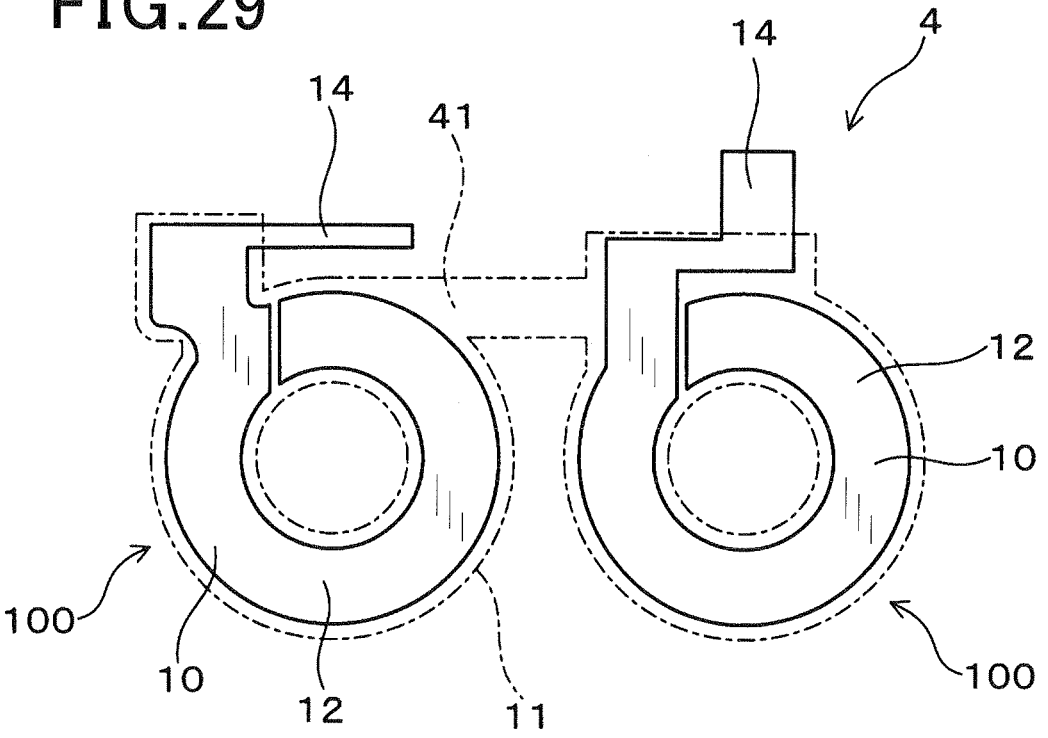
FIG. 29 is a plan view of a coil sheet according to a modification of the night embodiment before being folded.
Figure 30:
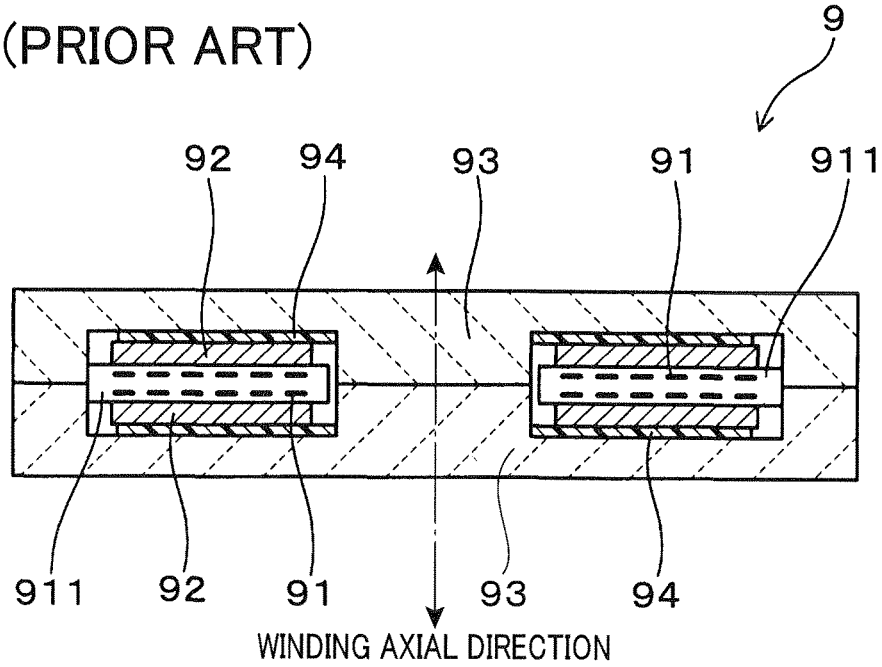
FIG.30 (PRIOR ART)
FIG. 30 is a cross-sectional view illustrating the overall configuration of a transformer according to the prior art.

Furthermore, as shown in FIG. 29, it is also possible to arrange only one of the coil terminals 14 to protrude parallel to the extending direction of the connecting portion 41 while arranging the other coil terminal 14 to protrude in a direction perpendicular to both the winding axial direction and the extending direction of the connecting portion 41 as in the first embodiment.

While the above particular embodiments and modifications have been shown and described, it will be understood by those skilled in the art that various further modifications, changes, and improvements may be made without departing from the spirit of the invention.

For example, in the previous embodiments, the first coils 10 are configured as high voltage-side coils, and the second coils 20 are configured as low voltage-side coils.

However, it is also possible to configure the first coils 10 as low voltage-side coils and the second coils 20 as high voltage-side coils.

What is claimed is:

1. A transformer comprising a pair of first coils and at least one second coil that are stacked so that the at least one second coil is interposed between the first coils in a common winding axial direction of the first and second coils, wherein each of the first coils is covered by insulating films and integrated with the insulating films into an integrated body, so that the first coils are electrically insulated from the at least one second coil, and wherein the integrated bodies, each of which is comprised of one of the first coils and the insulating films covering the one of the first coils, are integrally formed of a single coil sheet, in the coil sheet, the integrated bodies are connected with each other via a connecting portion, the coil sheet is folded at the connecting portion so that the integrated bodies are superposed in the winding axial direction with the at least one second coil interposed therebetween in the winding axial direction, the connecting portion of the coil sheet includes therein a connecting electric conductor that connects the first coils included in the respective integrated bodies, the connecting electric conductor is integrally formed with the first coils into one piece, each of the first coils is comprised of a plurality of coil segments that are stacked in the winding axial direction, between each adjacent pair of the coil segments, there is interposed an insulating film so as to electrically insulate the coil segments from each other, and each of the coil segments is interposed between an adjacent pair of the insulating films in the winding axial direction.

2. The transformer as set forth in claim 1, wherein the integrated bodies, each of which is comprised of one of the first coils and the insulating films covering the one of the first coils, are substantially annular-shaped, the at least one second coil is also substantially annular-shaped, and a radially inner periphery of the at least one second coil is positioned radially outside of radially inner peripheries of the insulating films of the integrated bodies, and a radially outer periphery of the at least one second coil is positioned radially inside of radially outer peripheries of the insulating films.

3. The transformer as set forth in claim 1, wherein the at least one second coil is bonded by an adhesive to a corresponding one of the integrated bodies each of which is comprised of one of the first coils and the insulating films covering the one of the first coils.

4. The transformer as set forth in claim 1, wherein in the coil sheet, there are provided two coil terminals that protrude respectively from the integrated bodies in a direction perpendicular to both the winding axial direction and an extending direction of the connecting portion of the coil sheet.

5. The transformer as set forth in claim 1, further comprising a core that is comprised of a pair of core pieces, wherein the integrated bodies, each of which is comprised of one of the first coils and the insulating films covering the one of the first coils, and the at least one second coil are together interposed between and thereby covered by the pair of core pieces in the winding axial direction.

6. The transformer as set forth in claim 5, wherein the integrated bodies and the at least one second coil are each substantially annular-shaped, each of the core pieces of the core has a center portion that extends in the winding axial direction, the center portions of the core pieces are inserted in a space formed radially inside of the integrated bodies and the at least one second coil, and the insulating films of the integrated bodies have extensions that extend in the winding axial direction along outer surfaces of the center portions of the core pieces, so as to be radially interposed between the outer surfaces of the center portions of the core pieces and a radially inner surface of the at least one second coil.

7. The transformer as set forth in claim 1, wherein each of the first coils is comprised of a large-linewidth coil segment and a small-linewidth coil segment that are stacked in the winding axial direction, the at least one second coil is directly thermally connected to a heat sink, and the first coils and the at least one second coil are stacked so that the large-linewidth coil segments of the first coils face the at least one second coil.

8. The transformer as set forth in claim 1, wherein between each adjacent pair of the coil segments, there is interposed only one insulating film.

* * * * *